US012385665B2

(12) United States Patent
Smith et al.

(10) Patent No.: US 12,385,665 B2
(45) Date of Patent: Aug. 12, 2025

(54) HEAT PUMP SYSTEMS AND METHODS WITH FROST MITIGATION

(71) Applicant: Johnson Controls Tyco IP Holdings LLP, Milwaukee, WI (US)

(72) Inventors: Jeremy Ryan Smith, Park City, KS (US); Thomas John Martin, Goddard, KS (US)

(73) Assignee: JOHNSON CONTROLS LIGHT COMMERCIAL IP GMBH, Neuhausen Am Rheinfall (CH)

( * ) Notice: Subject to any disclaimer, the term of this patent is extended or adjusted under 35 U.S.C. 154(b) by 141 days.

(21) Appl. No.: 18/199,139

(22) Filed: May 18, 2023

(65) Prior Publication Data

US 2023/0375212 A1 Nov. 23, 2023

Related U.S. Application Data

(60) Provisional application No. 63/343,864, filed on May 19, 2022.

(51) Int. Cl.

| | |
|---|---|
| ***F24F 11/84*** | (2018.01) |
| ***F24F 11/41*** | (2018.01) |
| ***F24F 11/65*** | (2018.01) |
| ***F24F 11/86*** | (2018.01) |
| *F24F 140/30* | (2018.01) |

(52) U.S. Cl.

CPC ..... *F24F 11/84* (2018.01); *F24F 11/41* (2018.01); *F24F 11/65* (2018.01); *F24F 11/86* (2018.01); *F24F 2140/30* (2018.01)

(58) Field of Classification Search

CPC .. F24F 11/41; F24F 11/42; F24F 11/65; F24F 11/84; F24F 11/86; F24F 2140/20; F25B 30/02; F25B 2600/2501

See application file for complete search history.

(56) References Cited

U.S. PATENT DOCUMENTS

| | | | | |
|---|---|---|---|---|
| 4,770,000 | A * | 9/1988 | Kuroda | F25B 41/20 62/196.3 |
| 6,012,294 | A * | 1/2000 | Utsumi | F24F 11/84 62/81 |
| 2017/0038125 | A1* | 2/2017 | Tani | F25B 47/022 |
| 2022/0357085 | A1* | 11/2022 | Sato | F25B 6/02 |

* cited by examiner

*Primary Examiner* — Marc E Norman

(74) *Attorney, Agent, or Firm* — Fletcher Yoder, P.C.

(57) ABSTRACT

A heat pump includes a working fluid circuit configured to circulate a working fluid therethrough. The working fluid circuit includes a first heat exchanger, a second heat exchanger, a compressor, and an expansion valve. The first heat exchanger is configured to exchange heat between the working fluid and a supply air flow, and the second heat exchanger is configured to exchange heat between the working fluid and an ambient air flow. The heat pump also includes a bypass circuit configured to direct a portion of the working fluid from the compressor to the second heat exchanger, a bypass valve configured to control a flow of the portion of the working fluid along the bypass circuit, and a controller configured to receive data indicative of a measured value of an operating parameter associated with formation of frost on the second heat exchanger and to control a position of the bypass valve based on a comparison of the measured value with a baseline value of the operating parameter.

20 Claims, 7 Drawing Sheets

HEAT PUMP SYSTEMS AND METHODS WITH FROST MITIGATION

CROSS-REFERENCE TO RELATED APPLICATIONS

This application claims priority to and the benefit of U.S. Provisional Application Ser. No. 63/343,864, entitled "SYSTEM AND METHOD FOR PREVENTING FROSTING ON A HEAT EXCHANGER," filed May 19, 2022, which is hereby incorporated by reference in its entirety for all purposes.

BACKGROUND

This section is intended to introduce the reader to various aspects of art that may be related to various aspects of the present disclosure, which are described below. This discussion is believed to be helpful in providing the reader with background information to facilitate a better understanding of the various aspects of the present disclosure. Accordingly, it should be understood that these statements are to be read in this light, and not as admissions of prior art.

A heating, ventilation, and/or air conditioning (HVAC) system may be used to thermally regulate an environment, such as a space within a building, home, or other structure. The HVAC system generally includes a vapor compression system having heat exchangers, such as a condenser and an evaporator, which transfer thermal energy between the HVAC system and the environment. Typically, a compressor is fluidly coupled to a refrigerant circuit of the vapor compression system and is configured to circulate a working fluid (e.g., refrigerant) between the condenser and the evaporator. In this way, the compressor facilitates heat exchange between the refrigerant, the condenser, and the evaporator. In some cases, refrigerant flow through the refrigerant circuit may be reversible, such that the condenser is operable as an evaporator (e.g., a heat absorber), and the evaporator is operable a condenser (e.g., a heat rejector). Accordingly, the HVAC system may operate as a heat pump system in multiple operating modes (e.g., a cooling mode, a heating mode) to provide both heating and cooling to the building with one refrigeration circuit.

In some instances, the heat pump may susceptible to formation and/or accumulation of frost on an outdoor coil of the heat pump, such as during operation of the heat pump in a heating mode and/or operation of the heat pump in a cold climate. Traditional heat pumps may be configured to operate in a conventional defrosting mode to remove frost formed on the outdoor coil. For example, typical heat pumps may switch operation from a heating mode to a cooling mode, thereby reversing the flow of refrigerant through the heat pump, in order to melt and remove frost accumulated on the outdoor coil. Thus, during defrosting operations, the heat pump operating in the cooling mode may be unable to provide heated air to a conditioned space to satisfy an existing call for heating. Some existing heat pumps may therefore include a supplemental heating system, such as a gas furnace or an electric heater, to heat air for supply to the conditioned space during defrosting operations. Unfortunately, traditional heat pump systems may operate inefficiently in conventional defrosting modes and/or may operate with unnecessary energy consumption and associated emissions.

SUMMARY

The present disclosure relates to a heat pump for a heating, ventilation, and air conditioning (HVAC) system.

The heat pump includes a working fluid circuit configured to circulate a working fluid therethrough, where the working fluid circuit includes a first heat exchanger, a second heat exchanger, a compressor, and an expansion valve, the first heat exchanger is configured to place the working fluid in a first heat exchange relationship with a supply air flow, and the second heat exchanger is configured to place the working fluid in a second heat exchange relationship with an ambient air flow. The heat pump also includes a bypass circuit of the working fluid circuit, where the bypass circuit is configured to direct a portion of the working fluid from the compressor to the second heat exchanger, and a bypass valve disposed along the bypass circuit and configured to control a flow of the portion of the working fluid along the bypass circuit. The heat pump further includes a controller configured to receive data indicative of a measured value of an operating parameter associated with formation of frost on the second heat exchanger and to control a position of the bypass valve based on a comparison of the measured value with a baseline value of the operating parameter.

The present disclosure also relates to a heat pump including a working fluid circuit having a compressor, an indoor heat exchanger, an expansion valve, an outdoor heat exchanger, and a reversing valve, where the working fluid circuit is configured to circulate a working fluid therethrough in a first flow direction in a cooling mode of the heat pump and to circulate the working fluid therethrough in a second flow direction, opposite the first flow direction, in a heating mode of the heat pump. The heat pump also includes a bypass circuit of the working fluid circuit, where the bypass circuit extends from a first location along the working fluid circuit between the compressor and the reversing valve to a second location along the working fluid circuit between the expansion valve and the outdoor heat exchanger and further includes a controller configured to receive data indicative of a measured value of an operating parameter associated with formation of frost on the outdoor heat exchanger and to control the heat pump to direct a portion of the working fluid along the bypass circuit based on a comparison of the measured value with a baseline value of the operating parameter.

The present disclosure further relates to a controller for a heat pump of a heating, ventilation, and air conditioning (HVAC) system including processing circuitry and a non-transitory, computer-readable medium comprising instructions stored thereon. The instructions, when executed by the processing circuitry, are configured to cause the processing circuitry to operate the heat pump in a heating mode to circulate a working fluid flow through a working fluid circuit, receive, from a sensor, data indicative of a measured value of an operating parameter associated with formation of frost on an outdoor heat exchanger of the working fluid circuit, compare the measured value with a baseline value of the operating parameter, in response to a determination that the measured value is less than the baseline value, adjust a bypass valve of a bypass circuit of the working fluid circuit toward an open position to direct a portion of the working fluid flow along the bypass circuit from a compressor to the outdoor heat exchanger, and in response to adjustment of the bypass valve toward the open position, modulate operation of the compressor to adjust a mass flow rate of a remaining portion of the working fluid flow from the compressor to an indoor heat exchanger of the working fluid circuit.

BRIEF DESCRIPTION OF THE DRAWINGS

Various aspects of this disclosure may be better understood upon reading the following detailed description and upon reference to the drawings in which.

DETAILED DESCRIPTION

Figure 1:
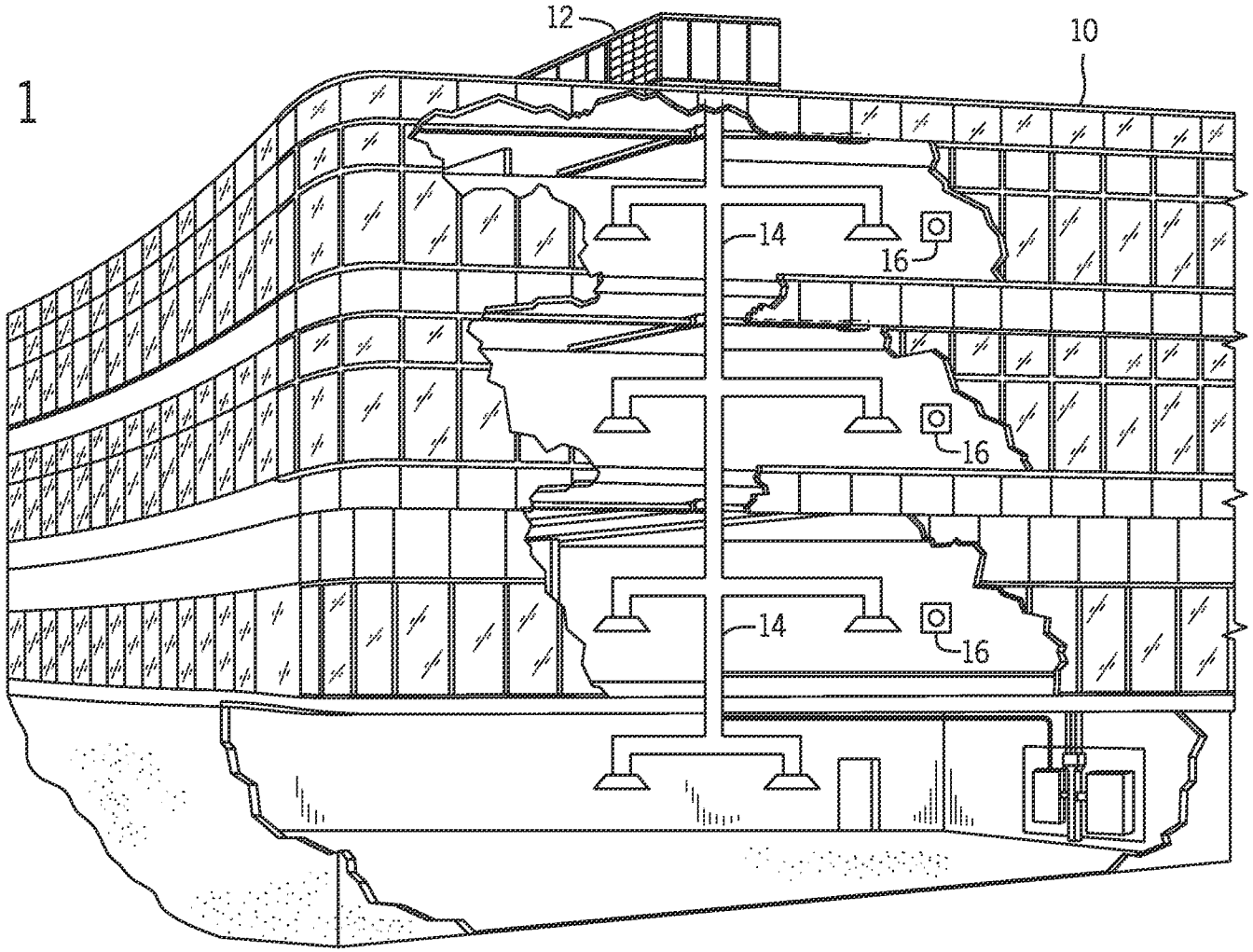
FIG. 1 is a perspective view of an embodiment of a building incorporating a heating, ventilation, and air conditioning (HVAC) system in a commercial setting, in accordance with an aspect of the present disclosure.

One or more specific embodiments of the present disclosure will be described below. These described embodiments are examples of the presently disclosed techniques. Additionally, in an effort to provide a concise description of these embodiments, all features of an actual implementation may not be described in the specification. It should be appreciated that in the development of any such actual implementation, as in any engineering or design project, numerous implementation-specific decisions must be made to achieve the developers' specific goals, such as compliance with system-related and business-related constraints, which may vary from one implementation to another. Moreover, it should be appreciated that such a development effort might be complex and time consuming, but would nevertheless be a routine undertaking of design, fabrication, and manufacture for those of ordinary skill having the benefit of this disclosure.

When introducing elements of various embodiments of the present disclosure, the articles "a," "an," and "the" are intended to mean that there are one or more of the elements. The terms "comprising," "including," and "having" are intended to be inclusive and mean that there may be additional elements other than the listed elements. Additionally, it should be understood that references to "one embodiment" or "an embodiment" of the present disclosure are not intended to be interpreted as excluding the existence of additional embodiments that also incorporate the recited features.

As used herein, the terms "approximately," "generally," and "substantially," and so forth, are intended to convey that the property value being described may be within a relatively small range of the property value, as those of ordinary skill would understand. For example, when a property value is described as being "approximately" equal to (or, for example, "substantially similar" to) a given value, this is intended to mean that the property value may be within +/−5%, within +/−4%, within +/−3%, within +/−2%, within +/−1%, or even closer, of the given value. Similarly, when a given feature is described as being "substantially parallel" to another feature, "generally perpendicular" to another feature, and so forth, this is intended to mean that the given feature is within +/−5%, within +/−4%, within +/−3%, within +/−2%, within +/−1%, or even closer, to having the described nature, such as being parallel to another feature, being perpendicular to another feature, and so forth. Further, it should be understood that mathematical terms, such as "planar," "slope," "perpendicular," "parallel," and so forth are intended to encompass features of surfaces or elements as understood to one of ordinary skill in the relevant art, and should not be rigidly interpreted as might be understood in the mathematical arts. For example, a "planar" surface is intended to encompass a surface that is machined, molded, or otherwise formed to be substantially flat or smooth (within related tolerances) using techniques and tools available to one of ordinary skill in the art. Similarly, a surface having a "slope" is intended to encompass a surface that is machined, molded, or otherwise formed to be oriented at an angle (e.g., incline) with respect to a point of reference using techniques and tools available to one of ordinary skill in the art.

As briefly discussed above, a heating, ventilation, and air conditioning (HVAC) system may be used to thermally regulate a space within a building, home, or other suitable structure. For example, the HVAC system may include a vapor compression system that operates to transfer thermal energy between a working fluid, such as a refrigerant, and a fluid to be conditioned, such as air. The vapor compression system includes heat exchangers, such as a condenser and an evaporator, which are fluidly coupled to one another via one or more conduits of a working fluid loop or circuit. A compressor may be used to circulate the working fluid through the conduits and other components of the working fluid circuit (e.g., an expansion device) and, thus, enable the transfer of thermal energy between components of the working fluid circuit (e.g., between the condenser and the evaporator) and one or more thermal loads (e.g., an environmental air flow, a supply air flow).

In some embodiments, the HVAC system may include a heat pump (e.g., a heat pump system, a reverse-cycle heat pump, an energy efficient heat pump) having a first heat exchanger (e.g., a heating and/or cooling coil, an indoor heat exchanger, the evaporator) positioned within or otherwise fluidly coupled to the space to be conditioned, a second heat exchanger (e.g., a heating and/or cooling coil, an outdoor heat exchanger, the condenser) positioned in or otherwise fluidly coupled to an ambient environment (e.g., the atmosphere), and a pump (e.g., the compressor) configured to circulate the working fluid (e.g., refrigerant) between the first and second heat exchangers to enable heat transfer between the thermal load and the ambient environment, for example. The heat pump system is operable to provide both cooling or heating to the space to be conditioned (e.g., a room, zone, or other region within a building) by adjusting a flow of the working fluid through the working fluid circuit.

For example, during operation of the heat pump system in a cooling mode, the compressor may direct working fluid through the working fluid circuit and the first and second heat exchangers in a first flow direction. While receiving working fluid in the first flow direction, the first heat exchanger (which may be positioned within the space to be conditioned) may operate as an evaporator and, thus, enable working fluid flowing through the first heat exchanger to absorb thermal energy from an air flow (e.g., supply air flow) directed to the space. Further, the second heat exchanger (which may be positioned in the ambient environment surrounding the heat pump system), may operate as a condenser to reject the heat absorbed by the working fluid flowing from the first heat exchanger (e.g., to an ambient air flow directed across the second heat exchanger). In this way, the heat pump system may facilitate cooling of the space or other thermal load serviced by (e.g., in thermal communication with) the first heat exchanger.

Conversely, during operation in a heating mode, a reversing valve (e.g., a switch-over valve) enables the compressor to direct working fluid through the working fluid circuit and the first and second heat exchangers in a second flow direction, opposite the first flow direction. While receiving working fluid in the second flow direction, the first heat exchanger may operate as a condenser instead of an evaporator, and the second heat exchanger may operate as an evaporator instead of a condenser. As such, the first heat exchanger may receive (e.g., from the second heat exchanger) a flow of heated working fluid to reject heat to thermal load serviced by the first heat exchanger (e.g., an air flow directed to the space) and, thus, facilitate heating of the thermal load. In this way, the heat pump system may facilitate either heating or cooling of the thermal load based on the selected operational mode of the heat pump system (e.g., based on a flow direction of working fluid along the working fluid circuit).

During operation of the HVAC system in the heating mode, the second heat exchanger (e.g., outdoor coil, outdoor heat exchanger) absorbs heat from an air flow (e.g., ambient air flow), thereby cooling the air flow. In some instances, moisture suspended or contained within the air flow may condense. For example, moisture condensed from the air flow may accumulate on a surface of the second heat exchanger as condensate. In certain conditions or implementations, such as when the outdoor ambient temperature (e.g., dew point) is near, at, and/or below freezing (i.e., 32° F.), liquid condensate may begin to freeze on the second heat exchanger to form frost and/or ice (e.g., freezing condensate, freezing moisture). As will be appreciated, formation of frost on the second heat exchanger may reduce efficiency and/or result in operational interruptions of the HVAC system. For example, frost formed on the second heat exchanger may inhibit heat transfer between the working fluid directed through the second heat exchanger and the air flow (e.g., ambient air flow) directed across the second heat exchanger. Accordingly, HVAC systems may be configured to operate in a defrost mode to remove frost formed on the second heat exchanger. In conventional HVAC systems, operation of a heat pump in a defrost mode may include switching from a heating mode to a cooling mode and temporarily operating the heat pump in the cooling mode (e.g., defrost mode). In the cooling mode (e.g., defrost mode), the second heat exchanger may reject heat from the working fluid to the air flow (e.g., ambient air flow) directed across the second heat exchanger. As a result, a temperature of the second heat exchanger may rise, and frost formed on the second heat exchanger may melt to form liquid condensate, which may flow off of the second heat exchanger thereafter. Additionally or alternatively, the frost may liquefy and evaporate to be removed from the second heat exchanger.

Unfortunately, conventional defrost modes for heat pumps are inefficient. As mentioned above, to operate in a conventional defrost mode, the heat pump may be temporarily operated in a cooling mode. Thus, the heat pump may not operate in the heating mode to satisfy a call for heating in the defrost mode. Some existing systems may include a supplemental heating system, such as a gas furnace or an electric heating coil, that may operate to heat a supply air flow during defrost operations, but such supplemental heating systems may undesirably consume energy and/or produce undesirable emissions.

Accordingly, embodiments of the present disclosure are directed to systems and methods that enable mitigation of frost formation on an outdoor heat exchanger (e.g., second heat exchanger) of a heat pump with improved efficiency and reduced emissions. For example, in accordance with present techniques, an HVAC system (e.g., heat pump) includes a hot gas bypass circuit configured to direct a portion of heated working fluid to the outdoor heat exchanger during operation of the heat pump in a heating mode. The portion of heated working fluid may increase the temperature of the outdoor heat exchanger, which may cause frost formed on the outdoor heat exchanger to melt and/or may block formation of frost on the outdoor heat exchanger (e.g., before frost forms). As the hot gas bypass circuit may direct the portion of heated working fluid to the outdoor heat exchanger to block formation of frost in the heating mode, the heat pump may continue to operate in the heating mode to heat a supply air flow. In other words, operation of the heat pump to satisfy a call for heating or heating demand may not be interrupted during utilization of the hot gas bypass circuit.

Present embodiments also include a control system configured to enable improved operation of the heat pump in the heating mode, such as during instances in which the hot gas bypass circuit directs a portion of heated working fluid to the outdoor heat exchanger. For example, the control system may adjust operation of a compressor of the heat pump to improve operation of the heat pump to heat a supply air flow. As described in further detail below, the hot gas bypass circuit may divert the portion of heated working fluid to flow to the outdoor heat exchanger instead of the indoor heat exchanger. Thus, the indoor heat exchanger (e.g., operating as a condenser in the heating mode) may receive less heated working fluid, which may result in decreased heating capacity of the heat pump. Accordingly, the control system may adjust operation of the compressor to increase the heating capacity of the heat pump (e.g., during frost mitigation operation). For example, a speed of the compressor may be increased to enable an increase in mass flow rate of the heated working fluid directed to the indoor heat exchanger. In some embodiments, the control system may increase the speed of the compressor to approach and/or achieve a desired working fluid pressure and/or temperature (e.g., target pressure, target temperature) at the indoor heat exchanger. In this way, the heat pump may continue operating in the heating mode to satisfy a call for heating with improved efficiency, reduced energy consumption, and reduced emissions, while also operating to block formation of frost on the outdoor heat exchanger.

Turning now to the drawings, FIG. 1 illustrates an embodiment of a heating, ventilation, and air conditioning (HVAC) system for environmental management that employs one or more HVAC units in accordance with the present disclosure. As used herein, an HVAC system includes any number of components configured to enable regulation of parameters related to climate characteristics, such as temperature, humidity, air flow, pressure, air quality, and so forth. For example, an "HVAC system" as used herein is defined as conventionally understood and as further described herein. Components or parts of an "HVAC system" may include, but are not limited to, all, some of, or individual parts such as a heat exchanger, a heater, an air flow control device, such as a fan, a sensor configured to detect a climate characteristic or operating parameter, a filter, a control device configured to regulate operation of an HVAC system component, a component configured to enable regulation of climate characteristics, or a combination thereof. An "HVAC system" is a system configured to provide such functions as heating, cooling, ventilation, dehumidification, pressurization, refrigeration, filtration, or any combination thereof. The embodiments described herein may be utilized in a variety of applications to control climate characteristics, such as residential, commercial, industrial, transportation, or other applications where climate control is desired.

In the illustrated embodiment, a building 10 is air conditioned by a system that includes an HVAC unit 12 in accordance with present embodiments. The building 10 may be a commercial structure or a residential structure. As shown, the HVAC unit 12 is disposed on the roof of the building 10; however, the HVAC unit 12 may be located in other equipment rooms or areas adjacent the building 10. The HVAC unit 12 may be a single package unit containing other equipment, such as a blower, integrated air handler, and so forth. In other embodiments, the HVAC unit 12 may be part of a split HVAC system, such as the system shown in FIG. 3, which includes an outdoor HVAC unit 58 and an indoor HVAC unit 56.

The HVAC unit 12 is an air-cooled device that implements a refrigeration cycle to provide conditioned air to the building 10. Specifically, the HVAC unit 12 may include one or more heat exchangers across which an air flow is passed to condition the air flow before the air flow is supplied to the building. In the illustrated embodiment, the HVAC unit 12 is a rooftop unit (RTU) that conditions a supply air stream, such as environmental air and/or a return air flow from the building 10. After the HVAC unit 12 conditions the air, the air is supplied to the building 10 via ductwork 14 extending throughout the building 10 from the HVAC unit 12. For example, the ductwork 14 may extend to various individual floors or other sections of the building 10. In certain embodiments, the HVAC unit 12 may be a heat pump that provides both heating and cooling to the building with one working fluid circuit configured to operate in different modes. In other embodiments, the HVAC unit 12 may include one or more working fluid circuits (e.g., refrigeration circuits) for cooling an air stream and a furnace for heating the air stream.

A control device 16, one type of which may be a thermostat, may be used to designate the temperature of the conditioned air. The control device 16 also may be used to control the flow of air through the ductwork 14. For example, the control device 16 may be used to regulate operation of one or more components of the HVAC unit 12 or other components, such as dampers and fans, within the building 10 that may control flow of air through and/or from the ductwork 14. In some embodiments, other devices may be included in the system, such as pressure and/or temperature transducers or switches that sense the temperatures and pressures of the supply air, return air, and so forth. Moreover, the control device 16 may include computer systems that are integrated with or separate from other building control or monitoring systems, and even systems that are remote from the building 10.

Figure 2:
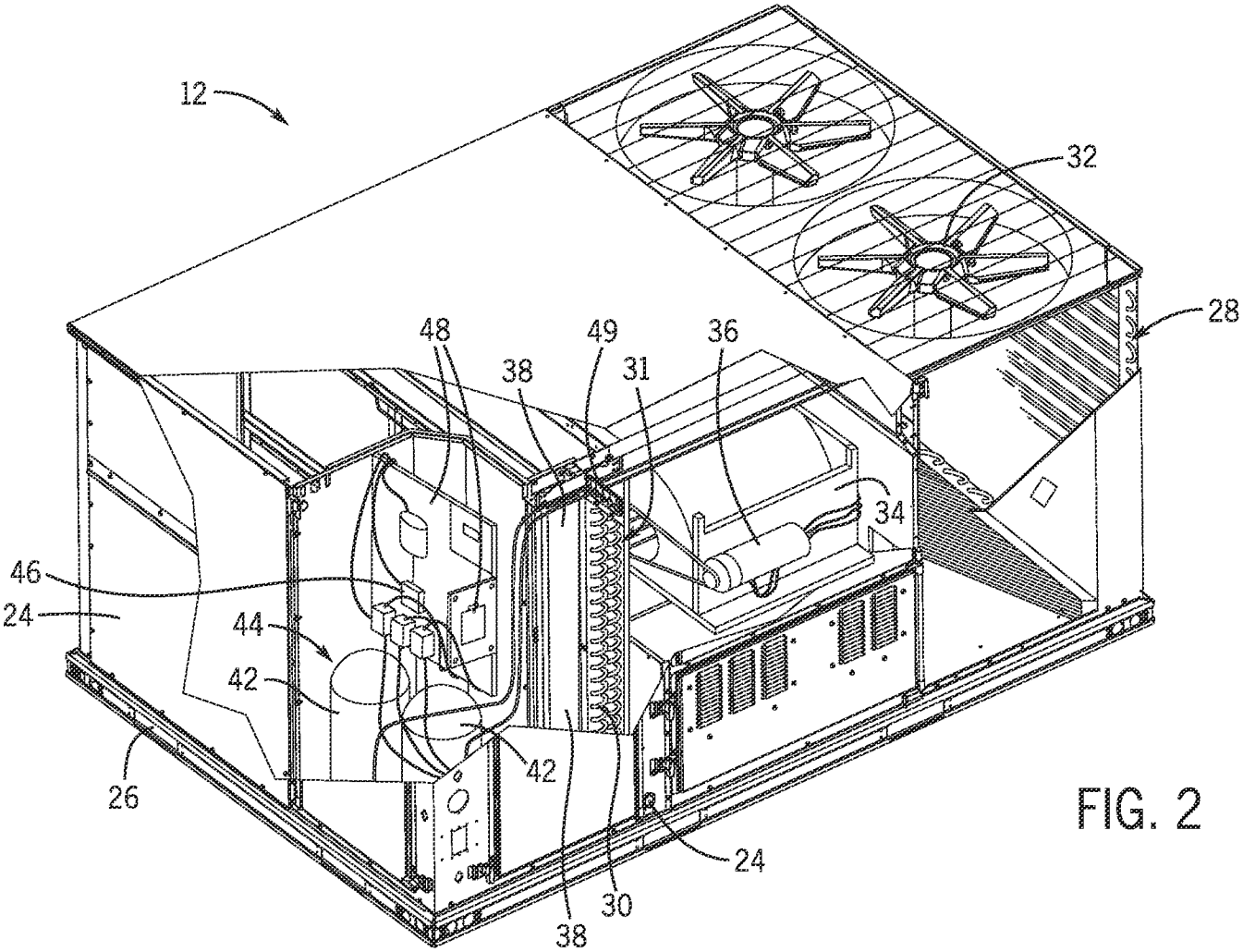
FIG. 2 is a perspective view of an embodiment of a packaged HVAC unit, in accordance with an aspect of the present disclosure.

FIG. 2 is a perspective view of an embodiment of the HVAC unit 12. In the illustrated embodiment, the HVAC unit 12 is a single package unit that may include one or more independent refrigeration circuits and components that are tested, charged, wired, piped, and ready for installation. The HVAC unit 12 may provide a variety of heating and/or cooling functions, such as cooling only, heating only, cooling with dehumidification, or cooling with a heat pump. As described above, the HVAC unit 12 may directly cool and/or heat an air stream provided to the building 10 to condition a space in the building 10.

As shown in the illustrated embodiment of FIG. 2, a cabinet 24 encloses the HVAC unit 12 and provides structural support and protection to the internal components from environmental and other contaminants. In some embodiments, the cabinet 24 may be constructed of galvanized steel and insulated with aluminum foil faced insulation. Rails 26 may be joined to the bottom perimeter of the cabinet 24 and provide a foundation for the HVAC unit 12. In certain embodiments, the rails 26 may provide access for a forklift and/or overhead rigging to facilitate installation and/or removal of the HVAC unit 12. In some embodiments, the rails 26 may fit into "curbs" on the roof to enable the HVAC unit 12 to provide air to the ductwork 14 from the bottom of the HVAC unit 12 while blocking elements such as rain from leaking into the building 10.

The HVAC unit 12 includes heat exchangers 28 and 30 in fluid communication with one or more refrigeration circuits (e.g., working fluid circuits). Tubes within the heat exchangers 28 and 30 may circulate working fluid (e.g., refrigerant), such as R-410A, through the heat exchangers 28 and 30. The tubes may be of various types, such as multichannel tubes, conventional copper or aluminum tubing, and so forth. Together, the heat exchangers 28 and 30 may implement a thermal cycle in which the working fluid undergoes phase changes and/or temperature changes as it flows through the heat exchangers 28 and 30 to produce heated and/or cooled air. For example, the heat exchanger 28 may function as a condenser where heat is released from the working fluid to ambient air, and the heat exchanger 30 may function as an evaporator where the working fluid absorbs heat to cool an air stream. In other embodiments, the HVAC unit 12 may operate in a heat pump mode where the roles of the heat exchangers 28 and 30 may be reversed. That is, the heat exchanger 28 may function as an evaporator and the heat exchanger 30 may function as a condenser. In further embodiments, the HVAC unit 12 may include a furnace for heating the air stream that is supplied to the building 10. While the illustrated embodiment of FIG. 2 shows the HVAC unit 12 having two of the heat exchangers 28 and 30, in other embodiments, the HVAC unit 12 may include one heat exchanger or more than two heat exchangers.

The heat exchanger 30 is located within a compartment 31 that separates the heat exchanger 30 from the heat exchanger 28. Fans 32 draw air from the environment through the heat exchanger 28. Air may be heated and/or cooled as the air flows through the heat exchanger 28 before being released back to the environment surrounding the HVAC unit 12. A blower assembly 34, powered by a motor 36, draws air through the heat exchanger 30 to heat or cool the air. The heated or cooled air may be directed to the building 10 by the ductwork 14, which may be connected to the HVAC unit 12. Before flowing through the heat exchanger 30, the conditioned air flows through one or more filters 38 that may remove particulates and contaminants from the air. In certain embodiments, the filters 38 may be disposed on the air intake side of the heat exchanger 30 to prevent contaminants from contacting the heat exchanger 30.

The HVAC unit 12 also may include other equipment for implementing the thermal cycle. Compressors 42 increase the pressure and temperature of the working fluid before the working fluid enters the heat exchanger 28. The compressors 42 may be any suitable type of compressors, such as scroll compressors, rotary compressors, screw compressors, or reciprocating compressors. In some embodiments, the compressors 42 may include a pair of hermetic direct drive compressors arranged in a dual stage configuration 44. However, in other embodiments, any number of the compressors 42 may be provided to achieve various stages of heating and/or cooling. As may be appreciated, additional equipment and devices may be included in the HVAC unit 12, such as a solid-core filter drier, a drain pan, a disconnect switch, an economizer, pressure switches, phase monitors, and humidity sensors, among other things.

The HVAC unit 12 may receive power through a terminal block 46. For example, a high voltage power source may be connected to the terminal block 46 to power the equipment. The operation of the HVAC unit 12 may be governed or regulated by a control board 48. The control board 48 may include control circuitry connected to a thermostat, sensors, and alarms. One or more of these components may be referred to herein separately or collectively as the control device 16. The control circuitry may be configured to control operation of the equipment, provide alarms, and monitor safety switches. Wiring 49 may connect the control board 48 and the terminal block 46 to the equipment of the HVAC unit 12.

Figure 3:
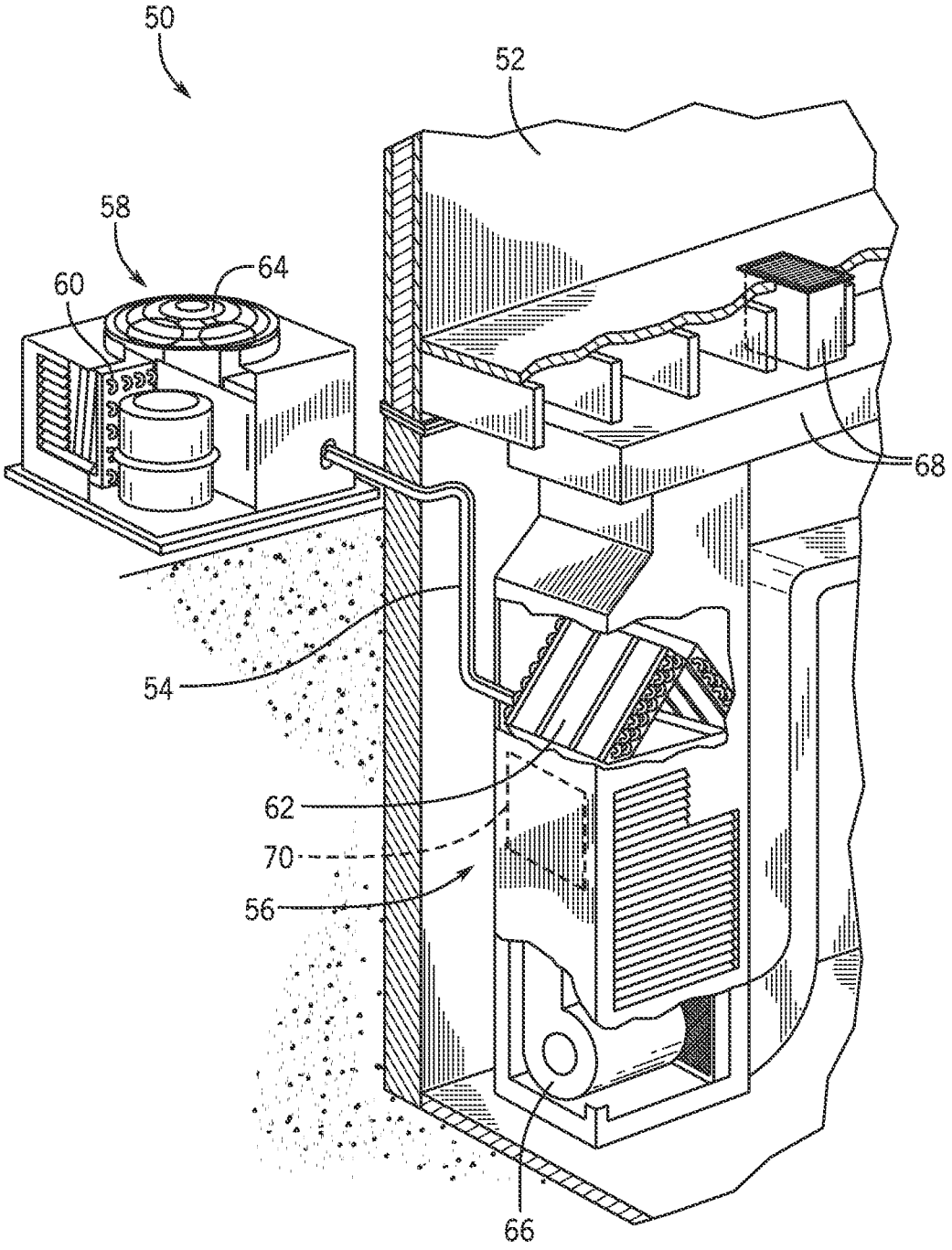
FIG. 3 is a perspective view of an embodiment of a split, residential HVAC system, in accordance with an aspect of the present disclosure.

FIG. 3 illustrates a residential heating and cooling system 50, also in accordance with present techniques. The residential heating and cooling system 50 may provide heated and cooled air to a residential structure, as well as provide outside air for ventilation and provide improved indoor air quality (IAQ) through devices such as ultraviolet lights and air filters. In the illustrated embodiment, the residential heating and cooling system 50 is a split HVAC system. In general, a residence 52 conditioned by a split HVAC system may include working fluid conduits 54 (e.g., refrigerant conduits) that operatively couple the indoor unit 56 to the outdoor unit 58. The indoor unit 56 may be positioned in a utility room, an attic, a basement, and so forth. The outdoor unit 58 is typically situated adjacent to a side of residence 52 and is covered by a shroud to protect the system components and to prevent leaves and other debris or contaminants from entering the unit. The working fluid conduits 54 transfer working fluid between the indoor unit 56 and the outdoor unit 58, typically transferring primarily liquid working fluid in one direction and primarily vaporized working fluid in an opposite direction.

When the system shown in FIG. 3 is operating as an air conditioner, a heat exchanger 60 in the outdoor unit 58 serves as a condenser for re-condensing vaporized working fluid flowing from the indoor unit 56 to the outdoor unit 58 via one of the working fluid conduits 54. In these applications, a heat exchanger 62 of the indoor unit functions as an evaporator. Specifically, the heat exchanger 62 receives liquid working fluid, which may be expanded by an expansion device, and evaporates the working fluid before returning it to the outdoor unit 58.

The outdoor unit 58 draws environmental air through the heat exchanger 60 using a fan 64 and expels the air above the outdoor unit 58. When operating as an air conditioner, the air is heated by the heat exchanger 60 within the outdoor unit 58 and exits the unit at a temperature higher than it entered. The indoor unit 56 includes a blower or fan 66 that directs air through or across the indoor heat exchanger 62, where the air is cooled when the system is operating in air conditioning mode. Thereafter, the air is passed through ductwork 68 that directs the air to the residence 52. The overall system operates to maintain a desired temperature as set by a system controller. When the temperature sensed inside the residence 52 is higher than the set point on the thermostat, or the set point plus a small amount, the residential heating and cooling system 50 may become operative to cool additional air for circulation through the residence 52. When the temperature reaches the set point, or the set point minus a small amount, the residential heating and cooling system 50 may stop the refrigeration cycle temporarily. The outdoor unit 58 may include a reheat system in accordance with present embodiments.

The residential heating and cooling system 50 may also operate as a heat pump. When operating as a heat pump, the roles of heat exchangers 60 and 62 are reversed. That is, the heat exchanger 60 of the outdoor unit 58 will serve as an evaporator to evaporate working fluid and thereby cool air entering the outdoor unit 58 as the air passes over the outdoor heat exchanger 60. The indoor heat exchanger 62 will receive a stream of air blown over it and will heat the air by condensing the working fluid.

In some embodiments, the indoor unit 56 may include a furnace system 70. For example, the indoor unit 56 may include the furnace system 70 when the residential heating and cooling system 50 is not configured to operate as a heat pump. The furnace system 70 may include a burner assembly and heat exchanger, among other components, inside the indoor unit 56. Fuel is provided to the burner assembly of the furnace 70 where it is mixed with air and combusted to form combustion products. The combustion products may pass through tubes or piping in a heat exchanger, separate from heat exchanger 62, such that air directed by the blower 66 passes over the tubes or pipes and extracts heat from the combustion products. The heated air may then be routed from the furnace system 70 to the ductwork 68 for heating the residence 52.

Figure 4:
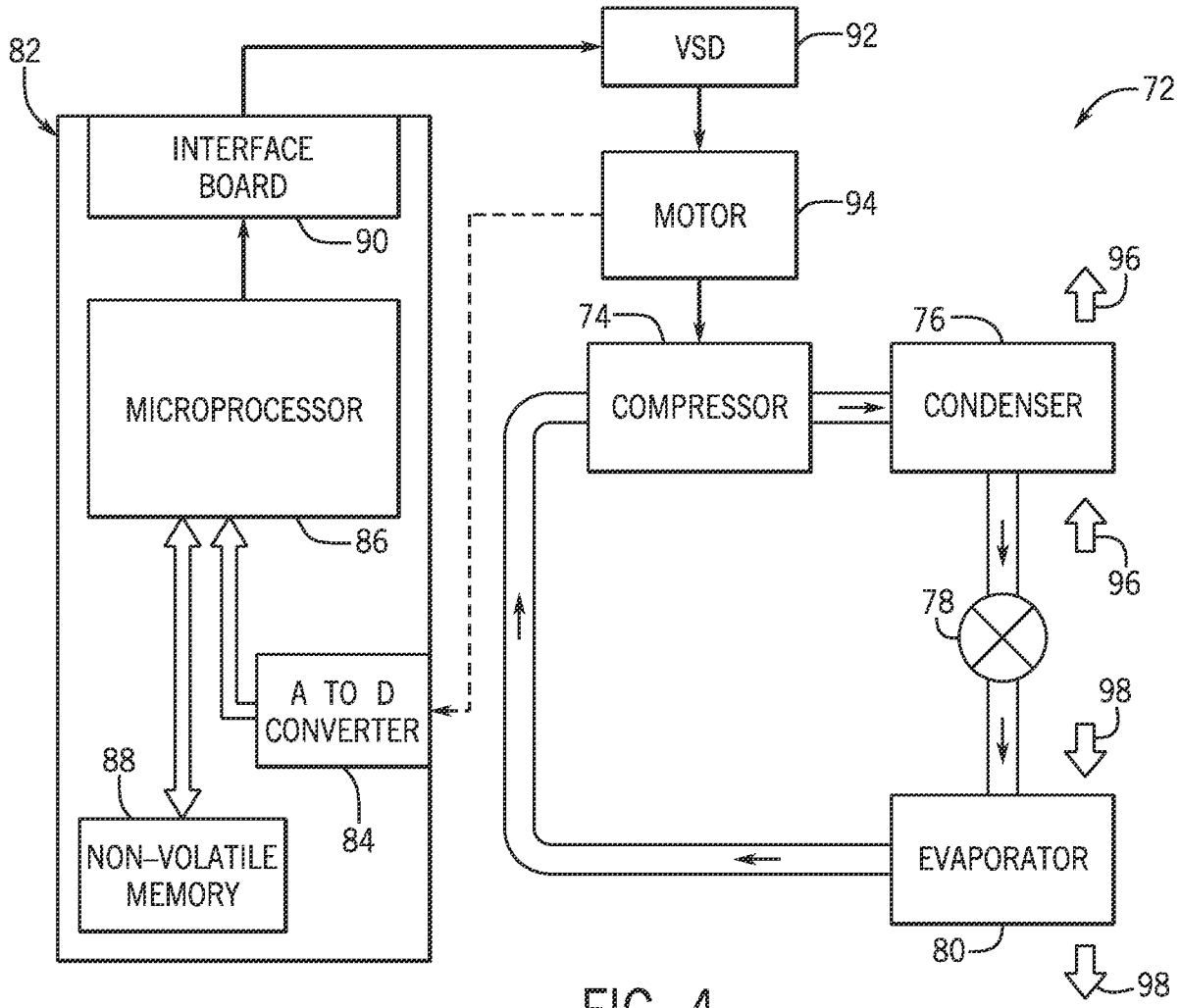
FIG. 4 is a schematic diagram of an embodiment of a vapor compression system used in an HVAC system, in accordance with an aspect of the present disclosure.

FIG. 4 is an embodiment of a vapor compression system 72 that can be used in any of the systems described above. The vapor compression system 72 may circulate a working fluid (e.g., refrigerant) through a circuit starting with a compressor 74. The circuit may also include a condenser 76, an expansion valve(s) or device(s) 78, and an evaporator 80. The vapor compression system 72 may further include a control panel 82 that has an analog to digital (A/D) converter 84, a microprocessor 86, a non-volatile memory 88, and/or an interface board 90. The control panel 82 and its components may function to regulate operation of the vapor compression system 72 based on feedback from an operator, from sensors of the vapor compression system 72 that detect operating conditions, and so forth.

In some embodiments, the vapor compression system 72 may use one or more of a variable speed drive (VSDs) 92, a motor 94, the compressor 74, the condenser 76, the expansion valve or device 78, and/or the evaporator 80. The motor 94 may drive the compressor 74 and may be powered by the variable speed drive (VSD) 92. The VSD 92 receives alternating current (AC) power having a particular fixed line voltage and fixed line frequency from an AC power source, and provides power having a variable voltage and frequency to the motor 94. In other embodiments, the motor 94 may be powered directly from an AC or direct current (DC) power source. The motor 94 may include any type of electric motor that can be powered by a VSD or directly from an AC or DC power source, such as a switched reluctance motor, an induction motor, an electronically commutated permanent magnet motor, or another suitable motor.

The compressor 74 compresses a working fluid vapor and delivers the vapor to the condenser 76 through a discharge passage. In some embodiments, the compressor 74 may be a centrifugal compressor. The working fluid vapor delivered by the compressor 74 to the condenser 76 may transfer heat to a fluid passing across the condenser 76, such as ambient or environmental air 96. The working fluid vapor may condense to a working fluid liquid in the condenser 76 as a result of thermal heat transfer with the environmental air 96. The liquid working fluid from the condenser 76 may flow through the expansion device 78 to the evaporator 80.

The liquid working fluid delivered to the evaporator 80 may absorb heat from another air stream, such as a supply air stream 98 provided to the building 10 or the residence 52. For example, the supply air stream 98 may include ambient or environmental air, return air from a building, or a combination of the two. The liquid working fluid in the evaporator 80 may undergo a phase change from the liquid working fluid to a working fluid vapor. In this manner, the evaporator 80 may reduce the temperature of the supply air stream 98 via thermal heat transfer with the working fluid. Thereafter, the vapor working fluid exits the evaporator 80 and returns to the compressor 74 by a suction line to complete the cycle.

In some embodiments, the vapor compression system 72 may further include a reheat coil. In the illustrated embodiment, the reheat coil is represented as part of the evaporator 80. The reheat coil is positioned downstream of the evaporator heat exchanger relative to the supply air stream 98 and may reheat the supply air stream 98 when the supply air stream 98 is overcooled to remove humidity from the supply air stream 98 before the supply air stream 98 is directed to the building 10 or the residence 52.

It should be appreciated that any of the features described herein may be incorporated with the HVAC unit 12, the residential heating and cooling system 50, or other HVAC systems. Additionally, while the features disclosed herein are described in the context of embodiments that directly heat and cool a supply air stream provided to a building or other load, embodiments of the present disclosure may be applicable to other HVAC systems as well. For example, the features described herein may be applied to mechanical cooling systems, free cooling systems, chiller systems, or other heat pump or refrigeration applications.

Figure 5:
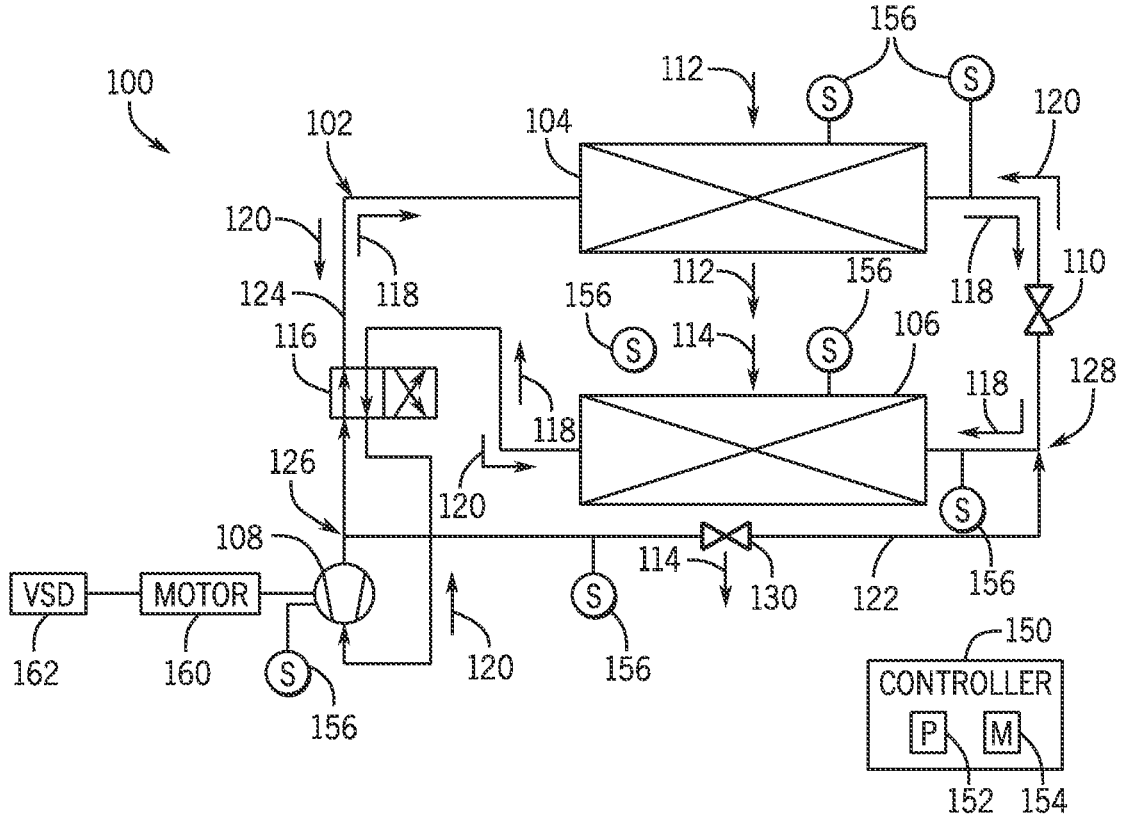
FIG. 5 is a schematic diagram of an embodiment of a heat pump including a hot gas bypass circuit, in accordance with an aspect of the present disclosure.

As briefly discussed above, embodiments of the present disclosure are directed to an HVAC system configured to enable improved operation during operating conditions that may otherwise cause formation of frost on an outdoor heat exchanger of the HVAC system. For example, the disclosed techniques may be incorporated with HVAC systems configured as a heat pump. The present techniques enable avoidance of frost formation on the outdoor heat exchanger while also enabling continued operation of the heat pump in a heating mode at a desired operating capacity to satisfy a heating demand on the heat pump. To provide context for the following discussion, FIG. 5 is a schematic of an embodiment of an HVAC system 100, also referred to herein as a heat pump, that includes a working fluid circuit 102 (e.g., refrigerant circuit, vapor compression circuit, vapor compression system), in accordance with present techniques. It should be appreciated that the HVAC system 100 may include embodiments or components of the HVAC unit 12 shown in FIGS. 1 and 2, embodiments or components of the split residential heating and cooling system 50 shown in FIG. 3, a rooftop unit (RTU), or any other suitable air handling unit or HVAC system.

In the illustrated embodiment, the working fluid circuit 102 is configured to circulate a working fluid therethrough and includes a first heat exchanger 104 (e.g., indoor heat exchanger, indoor coil), a second heat exchanger 106 (e.g., outdoor heat exchanger, outdoor coil), a compressor 108, and an expansion valve 110. The first heat exchanger 104 may be in thermal communication with (e.g., fluidly coupled to) a thermal load (e.g., a room, space, and/or device) serviced by the HVAC system 100, and the second heat exchanger 106 may be in thermal communication with an ambient environment (e.g., the atmosphere) surrounding the HVAC system 100. The first heat exchanger 104 may therefore facilitate heat exchange between working fluid within the first heat exchanger 104 and a first air flow 112 (e.g., supply air flow) directed across the first heat exchanger 104, and the second heat exchanger 106 may therefore facilitate heat exchange between working fluid within the second heat exchanger 106 and a second air flow 114 (e.g., ambient air flow) directed across the second heat exchanger 106.

The HVAC system 100 is also configured as a heat pump configured to operate in a cooling mode, whereby the first heat exchanger 104 may cool the first air flow 112, and a heating mode, whereby the first heat exchanger 104 may heat the first air flow 112. To this end, the working fluid circuit 102 includes a reversing valve 116 (e.g., switch-over valve, four-way valve) configured to adjust a flow direction of the working fluid through the working fluid circuit 102. In the illustrated embodiment, the reversing valve 116 is shown in a first configuration associated with operation of the HVAC system 100 (e.g., heat pump) in a heating mode. With the reversing valve 116 in the first configuration, working fluid may be circulated through the working fluid circuit 102 in a first flow direction 118. Accordingly, working fluid may be directed from the compressor 108, through the reversing valve 116, and to the first heat exchanger 104. Thus, the first heat exchanger 104 may receive heated working fluid from the compressor 108 and may transfer heat from the heated working fluid to the first air flow 112 in order to heat the first air flow 112 supplied to a conditioned space. Thereafter, the working fluid may be directed through the expansion valve 110 and then through the second heat exchanger 106 (e.g., to absorb heat from the second air flow 114) before the working fluid is directed back to the compressor 108.

The reversing valve 116 may also be positioned in a second configuration to enable flow of the working fluid through the working fluid circuit 102 in a second flow direction 120 and enable operation of the HVAC system 100 in a cooling mode. In the cooling mode, working fluid is directed from the compressor 108, through the second heat exchanger 106 (e.g., to reject heat to the second air flow 114), through the expansion valve 110 (e.g., to expand and cool the working fluid), and to the first heat exchanger 104. The first heat exchanger 104 may therefore receive cooled working fluid and may enable transfer of heat from the first air flow 112 to the cooled working fluid, thereby enabling cooling of the first air flow 112 supplied to a conditioned space.

In accordance with present techniques, the HVAC system 100 (e.g., working fluid circuit 102) also includes a hot gas bypass circuit 122 (e.g., hot gas bypass conduit). In the illustrated embodiment, the hot gas bypass circuit 122 is fluidly coupled to a main circuit 124 of the working fluid circuit 102 at a first location 126 downstream of the compressor 108 and upstream of the reversing valve 116, relative to flow of the working fluid from the compressor 108 to the reversing valve 116. The hot gas bypass circuit 122 is also fluidly coupled to the main circuit 124 of the working fluid circuit 102 at a second location 128 downstream of the expansion valve 110 and upstream of the second heat exchanger 106, relative to the first flow direction 118 of the working fluid through the working fluid circuit 102 in the heating mode. The HVAC system 100 also includes a bypass valve 130 (e.g., control valve, flow control valve, modulating valve, orifice, three-way valve) disposed along the hot gas bypass circuit 122. As described in further detail below, a position of the bypass valve 130 may be adjusted to control flow of working fluid through the hot gas bypass circuit 122. The bypass valve 130 may be any suitable valve or flow control device configured to control flow of working fluid through the hot gas bypass circuit 122

The HVAC system 100 further includes a controller 150 (e.g., a control system, a control panel, control circuitry) that is communicatively coupled to one or more components of the HVAC system 100 (e.g., compressor 108, expansion valve 110, reversing valve 116, bypass valve 130) and is configured to monitor, adjust, and/or otherwise control operation of the components of the HVAC system 100. For example, one or more control transfer devices, such as wires, cables, wireless communication devices, and the like, may communicatively couple the compressor 108, the expansion valve 110, the reversing valve 116, the bypass valve 130, the control device 16 (e.g., a thermostat), and/or any other suitable components of the HVAC system 100 to the controller 150. That is, the compressor 108, the expansion valve 110, the reversing valve 116, the bypass valve 130, and/or the control device 16 may each have one or more communication components that facilitate wired or wireless (e.g., via a network) communication with the controller 150. In some embodiments, the communication components may include a network interface that enables the components of the HVAC system 100 to communicate via various protocols such as EtherNet/IP, ControlNet, DeviceNet, or any other communication network protocol. Alternatively, the communication components may enable the components of the HVAC system 100 to communicate via mobile telecommunications technology, Bluetooth®, near-field communications technology, and the like. As such, the compressor 108, the expansion valve 110, the reversing valve 116, the bypass valve 130, and/or the control device 16 may wirelessly communicate data between each other. In other embodiments, operational control of certain components of the HVAC system 100 may be regulated by one or more relays or switches (e.g., a 24 volt alternating current [VAC] relay).

In some embodiments, the controller 150 may be a component of or may include the control panel 82. In other embodiments, the controller 150 may be a standalone controller, a dedicated controller, or another suitable controller included in the HVAC system 100. In any case, the controller 150 is configured to control components of the HVAC system 100 in accordance with the techniques discussed herein. The controller 150 includes processing circuitry 152, such as a microprocessor, which may execute software for controlling the components of the HVAC system 100. The processing circuitry 152 may include multiple microprocessors, one or more "general-purpose" microprocessors, one or more special-purpose microprocessors, and/or one or more application specific integrated circuits (ASICS), or some combination thereof. For example, the processing circuitry 152 may include one or more reduced instruction set (RISC) processors.

The controller 150 also include a memory device 154 (e.g., a memory) that may store information, such as instructions, control software, look up tables, configuration data, etc. The memory device 154 may include a volatile memory, such as random access memory (RAM), and/or a nonvolatile memory, such as read-only memory (ROM). The memory device 154 may store a variety of information and may be used for various purposes. For example, the memory device 154 may store processor-executable instructions including firmware or software for the processing circuitry 152 execute, such as instructions for controlling components of the HVAC system 100. In some embodiments, the memory device 154 is a tangible, non-transitory, machine-readable-medium that may store machine-readable instructions for the processing circuitry 152 to execute. The memory device 154 may include ROM, flash memory, a hard drive, or any other suitable optical, magnetic, or solid-state storage medium, or a combination thereof. The memory device 154 may store data, instructions, and any other suitable data.

As mentioned above, during operation of the HVAC system 100 (e.g., heat pump) in the heating mode, the second heat exchanger 106 (e.g., outdoor heat exchanger) may be susceptible to formation of frost on the second heat exchanger 106. In particular, during the heating mode, the second heat exchanger 106 may receive cooled working fluid (e.g., from the expansion valve 110) and may be configured to transfer heat from the second air flow 114 to the working fluid. Thus, the second heat exchanger 106 may cool the second air flow 114 in the heating mode of the HVAC system 100. As the second air flow 114 is cooled via the second heat exchanger 106, moisture within the second air flow 114 may condense and may collect on the second heat exchanger 106. In some circumstances or applications, moisture or condensate collected on the second heat exchanger 106 may be susceptible to freezing (e.g., formation of frost). The formation of frost on the second heat exchanger 106 may reduce efficiency of heat transfer between the working fluid and the second air flow 114, thereby resulting in less efficient operation of the HVAC system 100.

As mentioned above, the techniques disclosed herein are configured to enable a reduction in the formation of frost on the second heat exchanger 106 (e.g., outdoor heat exchanger), such as during operation of the HVAC system 100 in the heating mode. Specifically, the hot gas bypass circuit 122 is configured to direct a portion of working fluid discharged by the compressor 108 to the second heat exchanger 106. That is, the hot gas bypass circuit 122 is configured to direct the portion of working fluid to bypass the first heat exchanger 104 and the expansion valve 110 to enable supply of heated working fluid to the second heat exchanger 106. In this way, a temperature and/or pressure of working fluid within the second heat exchanger 106 may be increased, which may thereby increase a temperature of the second heat exchanger 106 and block formation of frost on the second heat exchanger 106. Similarly, an increase in the temperature of the second heat exchanger 106 may cause melting of frost formed on the second heat exchanger 106. Indeed, the hot gas bypass circuit 122 may direct the portion of working fluid from the compressor 108 to the second heat exchanger 106 during operation of the HVAC system 100 in the heating mode (e.g., circulation of working fluid through the main circuit 124 of the working fluid circuit 102 in the first flow direction 118). Therefore, unlike conventional heat pumps, the HVAC system 100 may continue to operate in the heating mode to heat the first air flow 112 while also causing (e.g., simultaneously) a reduction in frost formation on the second heat exchanger 106.

To enable flow of working fluid along the hot gas bypass circuit 122 (e.g., from the compressor 108 to the second heat exchanger 106), the bypass valve 130 may be adjusted from a closed position to an open position or an at least partially open position. The position of the bypass valve 130 may be adjusted by the controller 150. The controller 150 may be configured to adjust the position of the bypass valve 130 based on one or more operating parameters of the HVAC system 100. For example, the controller 150 may be configured to control the bypass valve 130 based on an operating mode of the HVAC system 100. Specifically, in a cooling mode of the HVAC system 100, whereby the second heat exchanger 106 is configured to reject heat from working fluid to the second air flow 114, the second heat exchanger 106 may not be susceptible to frost formation, and the controller 150 may therefore be configured to adjust the bypass valve 130 to be in a closed position in the cooling mode of the HVAC system 100. Therefore, working fluid may not flow along the hot gas bypass circuit 122 in the cooling mode.

The controller 150 may be configured to adjust the bypass valve 130 to be in an open or partially open position in the heating mode of the HVAC system 100. In the heating mode, the controller 150 may be configured to control the position of the bypass valve 130 based on one or more measured operating parameters of the HVAC system 100. To this end, the HVAC system 100 (e.g., the controller 150) may include one or more sensors 156 communicatively coupled to the controller 150 and configured to detect and/or measure one or more operating parameters of the HVAC system 100. The controller 150 may therefore receive feedback and/or data from the one or more sensors 156 indicative of the one or more operating parameters measured by the sensors 156. The one or more sensors 156 may be configured to detect a temperature of the second air flow 114 (e.g., an ambient temperature), a humidity of the second air flow 114, a temperature and/or pressure within the second heat exchanger 106, a surface temperature (e.g., coil temperature) of the second heat exchanger 106, a temperature and/or pressure of the working fluid within the second heat exchanger 106, temperature and/or pressure of the working fluid within the first heat exchanger 104, a flow rate of the working fluid through the working fluid circuit 102, a flow rate of the working fluid through the hot gas bypass circuit 122, an operating parameter (e.g., speed, frequency) of the compressor 108, another suitable operating parameter, and/or any combination thereof.

Based on the data and/or feedback received by the controller 150 (e.g., from the sensors 156), the controller 150 may determine (e.g., predict) whether the second heat exchanger 106 is susceptible to formation of frost thereon. For example, the controller 150 may determine that frost may form on the second heat exchanger 106 in response to a detected temperature or pressure of working fluid within the second heat exchanger 106 falling below a threshold value (e.g., baseline value, 32° F., 33° F., 34° F., etc.) or outside of a range of threshold values. Similarly, the controller 150 may predict an increased likelihood of frost formation in response a detected surface or coil temperature of the second heat exchanger 106 falling below a threshold value (e.g., baseline value, 32° F., 33° F., 34° F., etc.) or outside of a range of threshold values. However, it should be appreciated that the controller 150 may be configured to predict and/or otherwise determine that frost may form on the second heat exchanger 106 based on any suitable operating parameter (e.g., measured operating parameter) detected by one or more of the sensors 156. In some embodiments, the controller 150 may be configured to predict that frost is likely to form on the second heat exchanger 106 based on a determination that a detected operating parameter (e.g., working fluid temperature or pressure) deviates from a threshold valve (e.g., baseline value) by a threshold amount (e.g., a threshold percentage). For example, while moisture (e.g., liquid water) may freeze at 32° F. (i.e., freezing point of water), the controller 150 may determine (e.g., predict) that frost is likely to form in response to a detected temperature (e.g., second air flow 114 temperature, working fluid temperature in the second heat exchanger 106) at or below 33° F. or 34° F. (e.g., greater than the freezing point of water). In this way, the present techniques may enable mitigation of frost formation on the second heat exchanger 106 before frost has formed and/or accumulated on the second heat exchanger 106.

In response to a determination by the controller 150 that frost has formed, may form, and/or is likely to form (e.g., during the heating mode), the controller 150 may adjust the bypass valve 130 to an at least partially open position. Thus, a portion of working fluid discharged by the compressor 108 (e.g., a portion of heated working fluid) may be directed from the compressor 108 to the second heat exchanger 106 (e.g., an inlet of the second heat exchanger 106) via the hot gas bypass circuit 122. That is, the portion of working fluid may be directed from the first location 126 of the main circuit 124 to the second location 128 of the main circuit 124 by the hot gas bypass circuit 122. In other words, the portion of the working fluid directed by the hot gas bypass circuit 122 may bypass the first heat exchanger 104 and the expansion valve 110 and may instead flow (e.g., directly) from the compressor 108 to the second heat exchanger 106. In some embodiments, the portion of the working fluid may be combined with a remaining portion of the working fluid circulated through the main circuit 124 (e.g., at the second location 128) and may be directed to the second heat exchanger 106. As will be appreciated, the portion of working fluid directed along the hot gas bypass circuit 122 may increase an overall temperature (e.g., working fluid temperature) within the second heat exchanger 106. Indeed, the portion of heated working fluid may increase the temperature of the second heat exchanger 106 to block formation of frost on the second heat exchanger 106. Similarly, the portion of heated working fluid may increase the temperature of the second heat exchanger 106 to cause any frost already formed on the heat exchanger 106 to melt and flow off of the second heat exchanger 106.

In some embodiments, the controller 150 may adjust the position of the bypass valve 130, and therefore adjust an amount of the portion of the working fluid directed from the compressor 108 to the second heat exchanger 106 based on feedback from one or more of the sensors 156. For example, the controller 150 may adjust the bypass valve 130 to decrease an opening of the bypass valve 130 and decrease an amount or flow of the portion of the working fluid based on a determination that a temperature or pressure (e.g., working fluid temperature, working fluid pressure) within the second heat exchanger 106 rises above a threshold amount or level (e.g., baseline value). In some embodiments, the controller 150 may adjust the bypass valve 130 to maintain a temperature or pressure (e.g., working fluid temperature, working fluid pressure) within the second heat exchanger 106 above a desired value, such as above a threshold value greater than a freezing point of water.

With the bypass valve 130 at least partially opened to direct the portion of working fluid from the compressor 108 to the second heat exchanger 106 via the hot gas bypass circuit 122, a remaining portion of working fluid within the working fluid circuit 102 may be directed along the main circuit 124 of the working fluid circuit 102. That is, remaining portion of working fluid may be directed from the compressor 108 to the first heat exchanger 104 to enable heating of the first air flow 112 (e.g., supply air flow). As will be appreciated, an amount of the remaining portion of working fluid directed to the first heat exchanger 104 may be less than a total amount of the working fluid within the working fluid circuit 102 because the hot gas bypass circuit 122 diverts the portion of the working fluid to bypass the first heat exchanger 104 and flow to the second heat exchanger 106 from the compressor 108. As a result, a heating capacity of the first heat exchanger 104 may be reduced. For example, subsequent to adjustment of the bypass valve 130 to a partially open or open position, a temperature or pressure (e.g., working fluid temperature or pressure) within or downstream of the first heat exchanger 104 (e.g., receiving the remaining portion of working fluid) may decrease, such as due to a decreased mass flow rate of working fluid directed to the first heat exchanger 104.

Accordingly, present embodiments include techniques for increasing and/or maintaining a heating capacity of the first heat exchanger 104, such as during frost mitigation operations (e.g., frost mitigation mode) in which the portion of working fluid is directed from the compressor 108 to the second heat exchanger 106 via the hot gas bypass circuit 122. In particular, the controller 150 may be configured to adjust operation of the compressor 108 to achieve and/or maintain desired operation of the first heat exchanger 104 (e.g., to heat the first air flow 112) during the frost mitigation operation or mode of the HVAC system 100. To this end, the compressor 108 may be a multi-speed or variable speed compressor. That is, the compressor 108 may be adjustably driven by a motor 160 (e.g., motor 94) at each of a plurality of different speeds. In some embodiments, the compressor 108 may include a variable speed drive (VSD) 162 (e.g., VSD 92) configured to enable operation of the motor 160 and the compressor 108 at variable speeds. For example, the VSD 162 may be a variable frequency drive (VFD) configured to vary an input frequency and/or voltage provided to the motor 160 to adjust a speed of the compressor 108.

In some embodiments, during frost mitigation operations of the HVAC system 100, the controller 150 may adjust operation of the compressor 108 (e.g., the VSD 162) to increase a mass flow rate of the remaining portion of working fluid directed through the main circuit 124 of the working fluid circuit 102. For example, the controller 150 may adjust operation of the compressor 108 to achieve and/or maintain a desired operating parameter of the HVAC system 100, which may be detected by one or more of the sensors 156. In some embodiments, the controller 150 may control the compressor 108 (e.g., increase a frequency output by the VSD 162) to achieve and/or maintain a desired working fluid pressure within the first heat exchanger 104, a desired temperature (e.g., liquid temperature) of working fluid within or downstream of the first heat exchanger 104, a desired temperature or pressure of the working fluid at another location along the working fluid circuit 102, or any combination thereof. In this way, the controller 150 may operate the HVAC system 100 to maintain a desired operating capacity of the HVAC system 100 during the heating mode (e.g., in response to a call for heating) with simultaneous frost mitigation operation of the HVAC system 100. Additionally or alternatively, control of the compressor 108 may be adjusted (e.g., modulated) by the controller 150 based on and/or in response to other parameters, such as an amount of demand (e.g., heating demand) on the HVAC system 100. For example, the controller 150 may modulate the compressor 108 during frost mitigation operation (e.g., frost mitigation mode) based on a determined temperature differential between a temperature of the conditioned space and a set point temperature of the conditioned space. In some embodiments, the controller 150 may modulate the compressor 108 to achieve a target working fluid temperature or pressure within the first heat exchanger 104, and the target working fluid temperature or pressure may be determined based on a determined temperature differential between the temperature of the conditioned space and the set point temperature of the conditioned space. In this way, operation of the HVAC system 100 may be adjusted to operate at a desired capacity (e.g., heating capacity) while also operating to mitigate formation of frost on the second heat exchanger 106.

Figure 6:
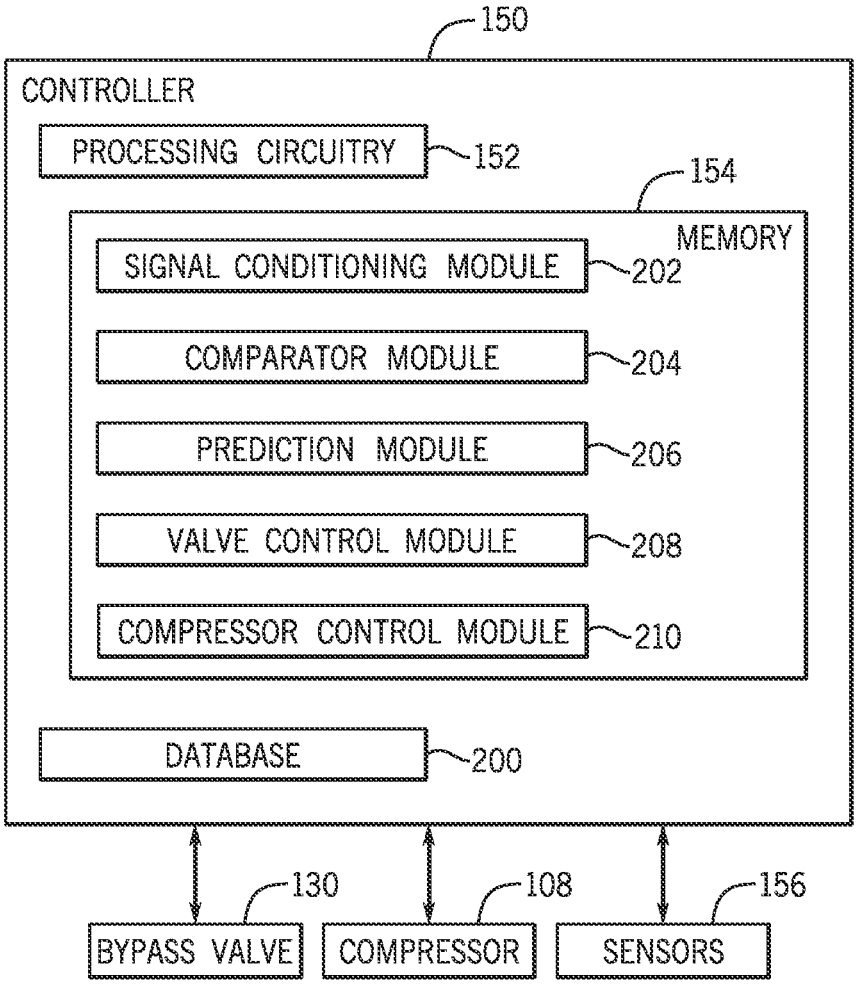
FIG. 6 is a schematic diagram of an embodiment of a control system for a heat pump, in accordance with an aspect of the present disclosure.

FIG. 6 is a schematic of an embodiment of the controller 150 configured to enable operation of the HVAC system 100 in accordance with the present techniques. As described above, the controller 150 may include the processing circuitry 152 (e.g., one or more processors) and the memory device 154, which may store information, data, and computer-executable instructions that, when executed by the processing circuitry 152, cause the controller 150 to perform the operations described herein. The controller 150 may also include a database 200. In some embodiments, the database 200 may be stored on the memory device 154. The database 200 may store values (e.g., parameter values) that may be referenced by the controller 150 during one or more operations described herein. For example, the database may store parameter values (e.g., baseline values) associated with formation of frost on the second heat exchanger 106. In some embodiments, the parameter values stored in the database 200 may be baseline parameter values that the controller 150 may reference and compare to measured or detected parameter values received from one or more of the sensors 156. Based on a comparison of a measured parameter value and a baseline parameter value, the controller 150 may determine whether to open or adjust the bypass valve 130, whether to adjust operation of the compressor 108 to achieve a desired operating capacity, or both. The database 200 may store baseline values for any suitable operating parameter of the HVAC system 100 (e.g., associated with frost formation), such as working fluid pressure, second heat exchanger 106 working fluid saturation temperature, ambient air temperature, and so forth.

In some embodiments, baseline parameter values stored in the database 200 may include baseline values that are established above or below a corresponding threshold value of a parameter (e.g., by a predetermined percentage) at which frost is expected to form on the second heat exchanger 106. For example, if frost is expected to form on the second heat exchanger 106 at or below a 32° F. temperature of ambient air (e.g., the second air flow 114) and at or below a 34° F. saturation temperature of the second heat exchanger 106 (e.g., working fluid in the second heat exchanger 106), corresponding baseline values for a temperature of the second air flow 114 that are above 32° F. and for a saturation temperature of working fluid in the second heat exchanger 106 that are above 34° F. may be stored in the database. In one embodiment, the baseline value for the temperature of the second air flow 114 may be approximately 34° F., and the baseline value for the saturation temperature of working fluid in the second heat exchanger 106 may be 36° F. The controller 150 may receive measured values of the temperature of the second air flow 114 and the saturation temperature of working fluid in the second heat exchanger 106 from the sensors 156 and may compare the measured values with the baseline values stored in the database 200. Based on a determination that the measured values are below the corresponding baseline values, the controller 150 may determine (e.g., predict) that frost may form on the second heat exchanger 106 and/or may determine that formation of frost is likely. In response, the controller 150 may initiate frost mitigation operations (e.g., frost mitigation mode), such as by opening the bypass valve 130 and by modulating operation of the compressor 108 to increase a mass flow rate of working fluid directed to the first heat exchanger 104. It should be appreciated that the database 200 may store any suitable baseline values for reference and comparison with measured parameter values to enable the operations described herein, such as baseline values associated with operation of the compressor 108 and/or the first heat exchanger 104.

In some embodiments, the memory device 154 may include additional features configured to enable the operations described herein. For example, the memory device 154 may include one or more modules (e.g., software modules, algorithms, executable instructions) configured to enable operation of the controller 150 in accordance with the present techniques. The modules may include software executable by the processing circuitry 152 to enable to functionality described herein. In the illustrated embodiment, the memory device 154 includes a signal conditioning module 202 configured to convert or transform signals received from the sensors 156. For example, the signal conditioning module 202 may include one or more analog to digital converters configured to convert analog data (e.g., sensed values) received from the sensors 156 into corresponding digital values.

The memory device 154 may also include a comparator module 204 configured to compare received sensed or detected parameter values with corresponding baseline values that may be stored in the database 200. Based on the comparisons, the comparator module 204 may generate comparison signals. For example, the comparator module 204 may receive a measured ambient air temperature value (e.g., first air flow 112 temperature value) from one of the sensors 156 (e.g., ambient air temperature sensor) and may compare the measured value with a corresponding ambient air temperature baseline value retrieved from the database 200. The comparator module 204 may further generate a first corresponding comparison signal in response to a determination that the measured ambient air temperature exceeds the stored ambient air temperature baseline value and may generate a second corresponding comparison signal in response to a determination that the measured ambient air temperature is below the stored ambient air temperature baseline value. Indeed, the comparator module 204 may be configured to generate comparison signals corresponding to comparisons of each received sensed parameter value (e.g., received from sensors 156) with a corresponding baseline value stored in the database 200.

The comparison signals generated by the comparator module 204 may be provided to a prediction module 206 of the memory device 154. The prediction module 206 may be configured to determine that frost has formed on the second heat exchanger 106 and/or that frost is more likely to form on the second heat exchanger 106 based on the comparison signals received from the comparator module 204. In some embodiments, the prediction module 206 may be configured to determine whether or not the formation of frost is likely or possible based on one or more predetermined rules (e.g., algorithms) stored on the memory device 154. The prediction module 206 may receive the comparison signals from the comparator module 204 and may apply the predetermined rules for assessing potential for frost formation. For example, the prediction module 206 may determine that frost formation is possible or likely based on a comparison signal indicative of a measured ambient air temperature value being below a stored ambient air temperature baseline value. In some embodiments, prediction module 206 may be configured to analyze or assess multiple operating parameters (e.g., multiple comparison signals) to determine the potential for frost formation. For example, if a sensed suction pressure value detected by one of the sensors 156 is below a corresponding baseline suction pressure value stored in the database 200, but a sensed ambient air temperature value detected by one of the sensors 156 is above a corresponding baseline ambient air temperature value stored in the database 200, the prediction module 206 may determine that formation of frost is unlikely or improbable. In some embodiments, the prediction module 206 may be configured to calculate a metric (e.g., a value between 0 and 100) indicative of a likelihood of frost formation, such as based on comparisons of one or more sensed operating parameter values and one or more baseline operating parameters values.

Based on one or more determinations of the prediction module 206 indicative of a likelihood of frost formation on the second heat exchanger 106, the prediction module 206 may be configured to enable control (e.g., adjustment) of the bypass valve 130 and/or the compressor 108 (e.g., via the VSD 162). For example, in response to a determination that frost has formed on the second heat exchanger 106, the prediction module 206 may output a first signal to a valve control module 208, and the valve control module 208 may instruct the bypass valve 130 to transition to a fully open position based on the first signal. In response to a determination that frost is likely to form or may form on the second heat exchanger 106, the prediction module 206 may output a second signal to the valve control module 208, and the valve control module 208 may instruct the bypass valve 130 to transition to a partially open position based on the second signal. In some embodiments, the prediction module 206 may output a signal to the valve control module 208 indicative of a likelihood (e.g., a percentage likelihood) of frost formation on the second heat exchanger 106, and in response the valve control module 208 may instruct the bypass valve 130 to adjust to a particular degree (e.g., amount) of opening associated with the particular likelihood of frost formation determined by the prediction module 206. Additionally or alternatively, the prediction module 206 may be configured to determine a particular degree of opening of the bypass valve 130 to achieve a target operating parameter value of an operating parameter, such as a target suction pressure, a target saturation temperature of working fluid in the second heat exchanger 106, or any other suitable target operating parameter (e.g., stored in the database 200). The particular degree of opening may be based on comparison of the target operating parameter value and a sensed value of the operating parameter. The prediction module 206 may send a signal to the valve control module 208 indicative of the particular degree of opening, and the valve control module 208 may control the bypass valve 130 to adjust in position to achieve the particular degree of opening.

To enable modulation of the compressor 108 in accordance with present techniques, the memory device 154 may include a compressor control module 210, in some embodiments. The compressor control module 210 may receive comparison signals from the comparator module 204, as similarly described above. That is, the comparator module 204 may receive one or more measured operating parameter values (e.g., associated with operation of the compressor 108) and may compare the measured operating parameter values with one or more corresponding baseline operating parameter values that may be stored in the database 200. In some embodiments, the compressor control module 210 may determine a manner in which the compressor 108 operation is to be modulated, such as based on the comparison signals received from the comparator module 204. As an example, the compressor control module 210 may determine an amount by which to increase the speed of the compressor 108 based on a determined or calculated difference between a measured saturated liquid working fluid temperature at the first heat exchanger 104 and a corresponding baseline value (e.g., threshold value, target value) stored in the database 200. Additionally or alternatively, the compressor control module 210 may determine an amount by which to increase the speed of the compressor 108 based on a determined or calculated difference between a measured discharge pressure of the working fluid and a corresponding baseline value (e.g., threshold value, target value) stored in the database 200. In some embodiments, the baseline value for an operating parameter may be a target or desired operating parameter value. For example, the baseline value may be based on (e.g., equal to, offset from) an expected value of the operating parameter (e.g., saturated liquid temperature of the working fluid) during operation of the HVAC system 100 with the bypass valve 130 in a closed position. Modulation of the compressor 108 may also be determined based on an amount of capacity or heating demanded of the HVAC system 100, as discussed above. Based on the determined modulation, the compressor control module 210 may instruct the compressor 108 (e.g., the VSD 162) to adjust operation accordingly. In this way, the compressor 108 may be operated to increase mass flow rate of working fluid to the first heat exchanger 104 and to achieve a desired operating capacity (e.g., heating capacity) during frost mitigation operation of the HVAC system 100.

In some embodiments, the compressor control module 210 may communicate (e.g., send signals to, receive signals from) the prediction module 206 and/or the valve control module 208. For example, the compressor control module 210 determine a desired modulation of the compressor 108 based on a likelihood of frost formation determined by the prediction module 206 and/or based on a position of the bypass valve 130 determined or implemented by the valve control module 208. In some embodiments, the compressor control module 210 may instruct the compressor 108 to increase in speed by a particular amount based on an amount of the portion of working fluid directed along the hot gas bypass circuit 122 (e.g., indicated by a position of the bypass valve 130). In this way, the compressor 108 may be operated to increase mass flow rate of working fluid to the first heat exchanger 104 by a desired amount to compensate for the portion of working fluid directed to the second heat exchanger 106 instead of the first heat exchanger 104.

Figure 7:
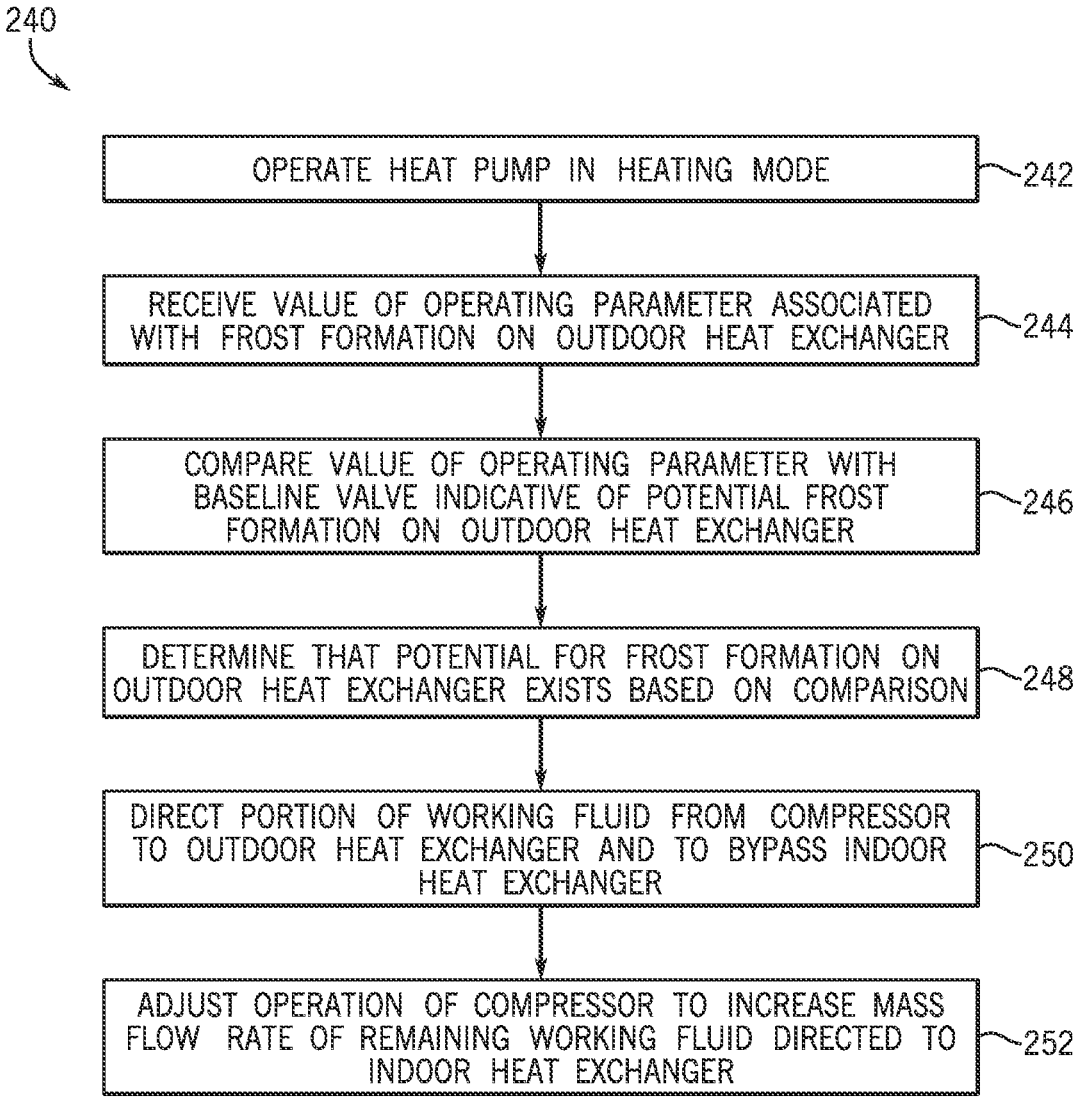
FIG. 7 is a flow chart of an embodiment of a method for controlling operation of a heat pump including a hot gas bypass circuit, in accordance with an aspect of the present disclosure.

FIG. 7 is a flowchart of an embodiment of a method 240 for adjusting operation of the HVAC system 100 (e.g., heat pump) to enable frost mitigation operations and to enable the HVAC system 100 operate in a heating mode (e.g., at a desired operating capacity) during the frost mitigation operations. In some embodiments, the method 240 may be performed by a single respective component or system, such as by the controller 150 (e.g., the processing circuitry 152). In additional or alternative embodiments, multiple components or systems may perform the steps of the method 240. It should also be noted that additional steps may be performed with respect to the method 240. Moreover, certain steps of the depicted method 240 may be removed, modified, and/or performed in a different order than that shown in FIG. 7.

First, at block 242, the HVAC system 100 (e.g., heat pump, reversible heat pump) is operated in a heating mode. As described in detail above, the reversing valve 116 may be positioned in a first configuration to direct working fluid along the working fluid circuit 102 in the first flow direction 118 in the heating mode. Thus, heated working fluid discharged by the compressor 108 may be directed to the first heat exchanger 104 (e.g., indoor heat exchanger) to enable transfer of heat from the working fluid to the first air flow 112 (e.g., supply air flow) in order to heat the first air flow 112 for supply to a conditioned space.

In the heating mode, the second heat exchanger 106 operates to transfer heat from the second air flow 114 (e.g., outdoor air flow, ambient air flow) to the working fluid within the second heat exchanger 106 (e.g., outdoor heat exchanger). During the heating mode, the second heat exchanger 106 may be susceptible to formation of frost thereon in certain operating conditions (e.g., low ambient temperatures). For example, as heat is transferred from the second air flow 114 to the working fluid, moisture within the second air flow 114 may condense and collect on the second heat exchanger 106, and the moisture may freeze to form frost on the second heat exchanger 106. Formation of frost on the second heat exchanger 106 may inhibit efficient operation (e.g., heat transfer) of the second heat exchanger 106, as well as other components of the HVAC system 100 (e.g., the compressor 108). Accordingly, present techniques are configured to enable mitigation of frost formation on the second heat exchanger 106.

To this end, at block 244, the method 240 include receiving a value of an operating parameter associated with frost formation on an outdoor heat exchanger, such as the second heat exchanger 106. For example, one or more sensors 156 of the HVAC system 100 may be configured to measure, sense, or otherwise detect a value of an operating parameter of the HVAC system 100 associated with frost formation on the second heat exchanger 106. In some embodiments, the one or more sensors 156 may a value of a temperature of ambient air (e.g., the second air flow 114), a temperature and/or pressure of working fluid (e.g., saturated temperature and/or pressure) within the second heat exchanger 106 (e.g., outdoor heat exchanger), a surface temperature (e.g., coil temperature) of the second heat exchanger 106, another suitable operating parameter associated with frost formation on the second heat exchanger 106, or any combination thereof. Data indicative of the one or more detected operating parameter values may be provided by the one or more sensors 156 to the controller 150 of the HVAC system 100.

At block 246, the value of the operating parameter (e.g., detected by one or more sensors 156) is compared with a baseline value indicative of potential frost formation on the outdoor heat exchanger (e.g., second heat exchanger 106). For example, the controller 150 may receive the value of the operating parameter from one of the sensors 156, and the controller 150 (e.g., comparator module 204) may compare the value with a baseline value (e.g., predetermined value, threshold value). In some embodiments, the baseline value may be stored in the memory device 154 and/or the database 200 of the controller 150. The baseline value may be a predetermined value of the operating parameter indicative of frost formation and/or potential frost formation on the second heat exchanger 106. In some embodiments, the operating parameter may be an ambient air temperature (e.g., temperature of the second air flow 114), and the baseline value may be a value indicative of potential frost formation (e.g., 34° F.) and/or an increased likelihood of frost formation. For example, if moisture freezes at 32° F., the baseline value may be a value greater than 32° F. to indicate an increased potential or risk of frost formation on the second heat exchanger 106. For example, the baseline value may be a predetermined percentage above or below a particular value of the operating parameter at which frost is formed. In other words, the baseline value may be associated with an increased risk of frost formation instead of an indication that frost has already formed on the outdoor heat exchanger.

In accordance with present techniques, the controller 150 may therefore control the HVAC system 100 to operate in a frost mitigation mode (e.g., via flow of the portion of working fluid along the hot gas bypass circuit 122) to reduce or mitigate the potential of frost formation on the second heat exchanger 106 (e.g., before frost is formed on the second heat exchanger 106). Further, as similarly discussed above, the step at block 246 may include the comparison of respective measured values of multiple operating parameters associated with frost formation with corresponding baseline values. Examples of operating parameter values that may be associated with frost formation may include a coil or surface temperature of the second heat exchanger 106, a suction temperature of the working fluid entering the compressor 108, a temperature or pressure of the working fluid (e.g., saturation temperature or pressure) at the second heat exchanger 106, and so forth. Each operating parameter may be compared with a corresponding baseline value that may be determined or selected in the manner discussed above.

At block 248, a determination that the potential for frost formation on the outdoor heat exchanger exists may be made based on the comparison performed at block 246. Continuing with the example above, based on a received value of 33° F. for an ambient temperature and comparison of the received value with the corresponding baseline value (e.g., 34° F.), a determination may be made that the potential for frost formation exists (e.g., risk of frost formation and/or likelihood of frost formation exists). As discussed above, the controller 150 (e.g., prediction module 206) may make the determination that the potential for frost formation on the outdoor heat exchanger exists based on the comparison (e.g., signals received from the comparator module 204). In accordance with present techniques, the controller 150 may determine that the potential for frost formation exists based on assessment (e.g., a holistic assessment) of multiple comparisons of measured operating values and corresponding baseline values.

Based on a determination that the potential of frost formation on the outdoor heat exchanger exists (e.g., risk of frost formation is greater than a threshold value), the controller 150 may operate the HVAC system 100 to direct a portion of working fluid from the compressor 108 to the outdoor heat exchanger (e.g., second heat exchanger 106), as indicated by block 250. In particular, the controller 150 may actuate the bypass valve 130 to transition to an open or partially open position to enable flow of the portion of working fluid through the hot gas bypass circuit 122. In some embodiments, a position of the bypass valve 130 may be determined by the controller 150 based on a determined differential between a measured value of an operating parameter and the corresponding baseline value. The position of the bypass valve 130 may additionally or alternatively be controlled based on other suitable operating parameters, such as a detected ambient temperature, a speed of the compressor 108, a working fluid temperature or pressure within the second heat exchanger 106, or any combination thereof. With the bypass valve 130 at least partially open, the second heat exchanger 106 may receive working fluid at a greater temperature and/or pressure, which may increase the temperature and/or pressure of the second heat exchanger 106 and reduce the potential for frost formation.

In some instances, the portion of the working fluid may cause a measured value of an operating parameter associated with frost formation to exceed the baseline value corresponding to the operating parameter. For example, one of the sensors 156 may detect a value of a coil or surface temperature of the second heat exchanger 106 that is above the corresponding baseline value. In response, the controller 150 may actuate the bypass valve 130 to transition the bypass valve 130 toward a closed position (e.g., reduce an opening of the bypass valve 130, close the bypass valve 130).

With the portion of working fluid directed from the compressor 108 to the second heat exchanger 106 via the hot gas bypass circuit 122, the first heat exchanger 104 (e.g., indoor heat exchanger) may receive less working fluid. Accordingly, the method 240 includes the step at block 252, whereby operation of the compressor 108 is adjusted to increase a mass flow rate of working fluid directed to the indoor heat exchanger (e.g., first heat exchanger 104). In some embodiments, the step at block 252 may be performed after a time delay is executed subsequent to performance of the step at block 250. In this way, the HVAC system 100 may operate with the portion of working fluid directed to the second heat exchanger 106 via the hot gas bypass circuit 122 and may reach a steady state condition prior to adjustment of compressor 108 operation. Thus, adjustment of the compressor 108 operation may be more suitably controlled. In some embodiments, a steady state condition of the HVAC system 100 may be determined and/or confirmed based on one or more detected operating parameter values of the HVAC system 100, such as detection of a stabilized working fluid temperature at the first heat exchanger 104 and/or working fluid discharge pressure.

At block 252, the operation of the compressor 108 may be adjusted by the controller 150, such as by increasing a speed of the compressor 108 (e.g., via control of the VSD 162). In some embodiments, prior to increasing a speed of the compressor 108, the controller 150 may determine whether the compressor 108 is already operating at an upper speed limit or threshold. In other words, the controller 150 may determine that the compressor 108 may operate with at an increased speed or capacity (e.g., available compressor 108 capacity exists). Based on a determination that the compressor 108 is not operating at an upper speed limit, the controller 150 may then adjust operation of the compressor 108 to increase the speed of the compressor 108.

In some embodiments, the controller 150 may adjust (e.g., modulate) operation of the compressor 108 to achieve a desired target or set point value of an operating parameter of the HVAC system 100. For example, the controller 150 may increase the speed of the compressor 108 to achieve a target value of the working fluid (e.g., liquid working fluid) in the first heat exchanger 104 and/or a target value of the discharge pressure of the working fluid. In some embodiments, the target value may be a value (e.g., previous measured value, plus or minus an offset) of the operating parameter at which the HVAC system 100 operated prior to opening of the bypass valve 130. Additionally or alternatively, the controller 150 may modulate the compressor 108 based on an amount of demand (e.g., heating demand) on the HVAC system 100, such as based on a temperature of a conditioned space (e.g., received from one of the sensors 156, received from the control device 16), a set point temperature of the conditioned space (e.g., received from the control device 16), a supply air temperature (e.g., temperature of the first air flow 112 downstream of the first heat exchanger 104), a temperature of return air received by the HVAC system 100, another suitable operating parameter indicative of an amount of demand, or any combination thereof. In some embodiments, the controller 150 may determine an operating speed of the compressor 108 based on a comparison of one or more of the parameters discussed above to a target or set point value (e.g., threshold value) of the one or more parameters. In this way, the compressor 108 may be operated to achieve a desired heating or operating capacity, such that the HVAC system 100 may continue operating in the heating mode to satisfy a call for heating while also operating to reduce or mitigate formation of frost on the second heat exchanger 106.

The compressor 108 may be modulated until the target value of the operating parameter is achieved and may then be operated until the call for heating is satisfied. However, in some instances, the speed of the compressor 108 may be increased to an upper speed threshold or limit, and the HVAC system 100 may nevertheless not operate to satisfy the call for heating. In some instances, the controller 150 may also determine that one or more values of the operating parameter associated with frost formation exceed the corresponding baseline value of the operating parameter. In such instances (e.g., extreme low ambient temperatures), the frost mitigation operation of the HVAC system 100 may be insufficient to mitigate formation of frost on the second heat exchanger 106. In response, the controller 150 may adjust operation of the bypass valve 130 to transition the bypass valve 130 toward the closed position. Further, in some embodiments, the controller 150 may, in response, control the HVAC system 100 to operate in a traditional defrost mode. That is, the controller 150 may actuate the reversing valve 116 to reverse the flow of working fluid through the working fluid circuit 102 and enable flow of heated working fluid (e.g., all working fluid in the working fluid circuit 102) to the second heat exchanger 106 in order to enable defrosting of the second heat exchanger 106.

Further, in some embodiments, based on a determination that the bypass valve 130 transitions from an open or partially open position to a closed position, which may be indicative of frost mitigation operations being suspended (e.g., due to a lower risk or decreased likelihood of frost formation), modulation of the compressor 108 to increase the mass flow rate of the remaining portion of working fluid to the first heat exchanger 104 may also be suspended. For example, the controller 150 may revert to operating the HVAC system 100 in a normal, heating operating mode.

Moreover, execution of the method 240 may be modified in some instance or circumstances. For example, the HVAC system 100 may be configured to operate in a normal defrost mode (e.g., defrost cycle), in which the HVAC system 100 operates to circulate the working fluid through the working fluid circuit 102 in the second flow direction 120, such as at a predetermined interval or upon lapse of a predetermined amount of time. In some embodiments, the controller 150 may be configured to operate the HVAC system 100 in the normal defrost mode for a predetermined amount of time (e.g., 5 minutes, 10 minutes, 15 minutes, etc.) every four hours, every six hours, every eight hours, or any other suitable time interval. The controller 150 may execute or monitor a timer to track the time interval and may initiate operation of the normal defrost mode at the expiration or conclusion of the time interval. In some embodiments, execution of the method 240 may be suspended during a particular portion or time window of each interval, such as a time window at the end of each time interval. As an example, for an embodiment of the HVAC system 100 configured to operate in a normal defrost mode every six hours, the controller 150 may be configured to suspend execution of the method 240 for the last hour (e.g., hour five to hour six) of the time interval. Thus, the HVAC system 100 may more thoroughly benefit from the intermittent operation in the normal defrost mode without diverting the portion of the working fluid via the hot gas bypass circuit 122, which may enable more efficient operation of the HVAC system 100 to satisfy a heating demand, as well as enable reduced energy consumption and corresponding emissions.

As set forth above, embodiments of the present disclosure may provide one or more technical effects useful for operating HVAC systems, such as heat pumps, during operational conditions and/or modes that may be susceptible to formation of frost on an outdoor heat exchanger. In particular, present embodiments include an HVAC system (e.g., heat pump) having a hot gas bypass circuit with a bypass valve configured to direct a portion of a heated working fluid from a compressor to an outdoor heat exchanger during operation of the HVAC system in a heating mode. The HVAC system is also configured to modulate operation of the compressor to increase flow of a remaining portion of the working fluid to an indoor heat exchanger to enable the HVAC system to satisfy a heating demand in the heating while also operating to mitigate formation of frost on the outdoor heat exchanger. It should be understood that the technical effects and technical problems in the specification are examples and are not limiting. Indeed, it should be noted that the embodiments described in the specification may have other technical effects and can solve other technical problems.

While only certain features and embodiments have been illustrated and described, many modifications and changes may occur to those skilled in the art, such as variations in sizes, dimensions, structures, shapes and proportions of the various elements, values of parameters, such as temperatures and pressures, mounting arrangements, use of materials, colors, orientations, and so forth, without materially departing from the novel teachings and advantages of the subject matter recited in the claims. The order or sequence of any process or method steps may be varied or re-sequenced according to alternative embodiments. It is, therefore, to be understood that the appended claims are intended to cover all such modifications and changes as fall within the true spirit of the disclosure.

Furthermore, in an effort to provide a concise description of the exemplary embodiments, all features of an actual implementation may not have been described, such as those unrelated to the presently contemplated best mode, or those unrelated to enablement. It should be appreciated that in the development of any such actual implementation, as in any engineering or design project, numerous implementation specific decisions may be made. Such a development effort might be complex and time consuming, but would nevertheless be a routine undertaking of design, fabrication, and manufacture for those of ordinary skill having the benefit of this disclosure, without undue experimentation.

The techniques presented and claimed herein are referenced and applied to material objects and concrete examples of a practical nature that demonstrably improve the present technical field and, as such, are not abstract, intangible or purely theoretical. Further, if any claims appended to the end of this specification contain one or more elements designated as "means for [perform]ing [a function] . . . " or "step for [perform]ing [a function] . . . ", it is intended that such elements are to be interpreted under 35 U.S.C. 112(f). However, for any claims containing elements designated in any other manner, it is intended that such elements are not to be interpreted under 35 U.S.C. 112(f).

The invention claimed is:

1. A heat pump for a heating, ventilation, and air conditioning (HVAC) system, comprising:

a working fluid circuit configured to circulate a working fluid therethrough, wherein the working fluid circuit comprises a first heat exchanger, a second heat exchanger, a compressor, and an expansion valve, wherein the first heat exchanger is configured to place the working fluid in a first heat exchange relationship with a supply air flow, and the second heat exchanger is configured to place the working fluid in a second heat exchange relationship with an ambient air flow;

a bypass circuit of the working fluid circuit, wherein the bypass circuit is configured to direct a portion of the working fluid from the compressor to the second heat exchanger;

a bypass valve disposed along the bypass circuit and configured to control a flow of the portion of the working fluid along the bypass circuit; and a controller configured to:

receive data indicative of a measured value of an operating parameter associated with formation of frost on the second heat exchanger;

control a position of the bypass valve based on a comparison of the measured value with a baseline value of the operating parameter;

receive, from a sensor, data indicative of a parameter of the working fluid within the first heat exchanger; and increase a speed of the compressor such that the parameter of the working fluid within the first heat exchanger approaches a target value.

2. The heat pump of claim 1, wherein the working fluid circuit comprises a reversing valve, the controller is configured to position the reversing valve in a first configuration in a cooling mode of the heat pump to direct the working fluid from the compressor to the second heat exchanger, and the controller is configured to position the reversing valve in a second configuration in a heating mode of the heat pump to direct the working fluid from the compressor to the first heat exchanger.

3. The heat pump of claim 2, wherein the controller is configured to adjust the position of the bypass valve to a closed position in the cooling mode of the heat pump.

4. The heat pump of claim 1, wherein the operating parameter is a temperature of the ambient air flow, and the baseline value is greater than a freezing point of water.

5. The heat pump of claim 1, wherein the operating parameter is a temperature of the second heat exchanger, and the baseline value is greater than a freezing point of water.

6. The heat pump of claim 1, wherein the controller is configured to modulate operation of the compressor in response to an adjustment of the position of the bypass valve toward an open position.

7. The heat pump of claim 6, wherein the controller is configured to increase the speed of the compressor in response to the adjustment of the position of the bypass valve toward the open position.

8. The heat pump of claim 1, comprising a variable speed drive operatively coupled to the compressor, wherein the controller is configured to adjust operation of the variable speed drive to increase the speed of the compressor.

9. The heat pump of claim 1, wherein the controller is configured to adjust the bypass valve toward a closed position in response to a determination that the measured value is greater than the baseline value.

10. The heat pump of claim 1, wherein the parameter of the working fluid within the first heat exchanger comprises a temperature, and the target value comprises a target temperature value.

11. The heat pump of claim 1, wherein the parameter of the working fluid within the first heat exchanger comprises a pressure, and the target value comprises a target pressure value.

12. A heat pump, comprising:

a working fluid circuit comprising a compressor, an indoor heat exchanger, an expansion valve, an outdoor heat exchanger, and a reversing valve, wherein the working fluid circuit is configured to circulate a working fluid therethrough in a first flow direction in a cooling mode of the heat pump and to circulate the working fluid therethrough in a second flow direction, opposite the first flow direction, in a heating mode of the heat pump a bypass circuit of the working fluid circuit, wherein the bypass circuit extends from a first location along the working fluid circuit between the compressor and the reversing valve to a second location along the working fluid circuit between the expansion valve and the outdoor heat exchanger; and a controller configured to:

receive data indicative of a measured value of an operating parameter associated with formation of frost on the outdoor heat exchanger;

control the heat pump to direct a portion of the working fluid along the bypass circuit based on a comparison of the measured value with a baseline value of the operating parameter;

receive, from a sensor, data indicative of a parameter of the working fluid within the indoor heat exchanger; and increase a speed of the compressor such that the parameter of the working fluid within the indoor heat exchanger approaches a target value.

13. The heat pump of claim 12, comprising a bypass valve disposed along the bypass circuit, wherein the controller is configured to adjust a position of the bypass valve to control flow of the portion of the working fluid along the bypass circuit.

14. The heat pump of claim 13, wherein the controller is configured to adjust the position of the bypass valve to a closed position in the cooling mode of the heat pump.

15. The heat pump of claim 13, wherein the controller is configured to adjust the position of the bypass valve toward an open position in response to a determination that the measured value is less than the baseline value.

16. The heat pump of claim 15, wherein the operating parameter comprises an ambient temperature or a temperature of the outdoor heat exchanger, and the baseline value comprises a temperature value greater than a freezing point of water.

17. A controller for a heat pump of a heating, ventilation, and air conditioning (HVAC) system, comprising:

processing circuitry; and a non-transitory, computer-readable medium comprising instructions stored thereon, wherein the instructions, when executed by the processing circuitry, are configured to cause the processing circuitry to:

operate the heat pump in a heating mode to circulate a working fluid flow through a working fluid circuit;

receive, from a sensor, data indicative of a measured value of an operating parameter associated with formation of frost on an outdoor heat exchanger of the working fluid circuit;

compare the measured value with a baseline value of the operating parameter;

in response to a determination that the measured value is less than the baseline value, adjust a bypass valve of a bypass circuit of the working fluid circuit toward an open position to direct a portion of the working fluid flow along the bypass circuit from a compressor to the outdoor heat exchanger;

in response to adjustment of the bypass valve toward the open position, modulate a speed of the compressor to adjust a mass flow rate of a remaining portion of the working fluid flow from the compressor to an indoor heat exchanger of the working fluid circuit;

receive, from an additional sensor, data indicative of a detected value of a parameter of the remaining portion of the working fluid flow at the indoor heat exchanger; and increase the speed of the compressor such that the detected value of the parameter of the remaining portion of the working fluid flow at the indoor heat exchanger approaches a target value.

18. The controller of claim 17, wherein the operating parameter comprises an ambient air temperature, a temperature of the outdoor heat exchanger, or both, the non-transitory, computer-readable medium comprises the baseline value stored thereon, and the baseline value comprises a temperature value greater than a freezing point of water.

19. The controller of claim 17, wherein the instructions, when executed by the processing circuitry, are configured to cause the processing circuitry to adjust the bypass valve toward a closed position in response to operation of the heat pump in a cooling mode.

20. The controller of claim 17, wherein the detected value of the parameter of the remaining portion of the working fluid flow at the indoor heat exchanger comprises a detected temperature value of the remaining portion of the working fluid flow at the indoor heat exchanger, and the target value comprises a target temperature value.

* * * * *